US010443166B2

(12) United States Patent
Krauser et al.

(10) Patent No.: US 10,443,166 B2
(45) Date of Patent: Oct. 15, 2019

(54) BRAIDED TEXTILE SLEEVE WITH INTEGRATED OPENING AND SELF-SUSTAINING EXPANDED AND CONTRACTED STATES AND METHOD OF CONSTRUCTION THEREOF

(71) Applicant: Federal-Mogul Powertrain, LLC, Southfield, MI (US)

(72) Inventors: Leigh Krauser, Pomeroy, PA (US); Tianqi Gao, Exton, PA (US); Zhong Huai Zhang, Pottstown, PA (US); Michael Piotrowski, Plymouth Meeting, PA (US)

(73) Assignee: Federal-Mogul Powertrain LLC, Southfield, MI (US)

( * ) Notice: Subject to any disclaimer, the term of this patent is extended or adjusted under 35 U.S.C. 154(b) by 425 days.

(21) Appl. No.: 15/337,750

(22) Filed: Oct. 28, 2016

(65) Prior Publication Data

US 2017/0121871 A1 May 4, 2017

Related U.S. Application Data

(60) Provisional application No. 62/248,888, filed on Oct. 30, 2015.

(51) Int. Cl.

| | |
|---|---|
| ***D04C 1/02*** | (2006.01) |
| ***D04C 1/08*** | (2006.01) |
| ***D04C 1/06*** | (2006.01) |

(52) U.S. Cl.

CPC ..... *D04C 1/02* (2013.01); *D04C 1/06* (2013.01); *D04C 1/08* (2013.01); *D10B 2401/046* (2013.01); *D10B 2505/12* (2013.01)

(58) Field of Classification Search

CPC ..... D04C 1/02; D04C 1/06; D10B 2401/046

See application file for complete search history.

(56) References Cited

U.S. PATENT DOCUMENTS 4,929,478 A 5/1990 Conaghan et al.
5,186,992 A * 2/1993 Kite, III ..... D04C 1/02 428/198

(Continued)

FOREIGN PATENT DOCUMENTS

| | | |
|---|---|---|
| EP | 1463177 A1 | 9/2004 |
| GB | 13508 A | 2/1913 |
| WO | 9114034 A1 | 9/1991 |

OTHER PUBLICATIONS

International Search Report, dated Feb. 23, 2017 (PCT/US2016/059628).

*Primary Examiner* — Shaun R Hurley
(74) *Attorney, Agent, or Firm* — Robert L. Stearns; Dickinson Wright, PLLC

(57) ABSTRACT

A protective textile having at least one integrated opening and method of construction thereof is provided. The sleeve includes a braided, tubular wall extending lengthwise in relation to a central longitudinal axis between opposite ends. The wall has a first state with a decreased length, increased cross-sectional area and a second state with an increased length, decreased cross-sectional area, as viewed in cross-section taken generally transversely to the central longitudinal axis. The wall further includes braided, heat-set yarns imparting a bias on the wall, wherein the bias causes the wall to remain substantially in the first and second states absent some externally applied force. The wall also includes at least one opening having a circumferentially continuous periphery bounding the opening, wherein the periphery is formed, at least in part, by braided yarns reversing direction from one S or Z helical direction to the opposite S or Z helical direction.

27 Claims, 18 Drawing Sheets

(56) References Cited

U.S. PATENT DOCUMENTS

| | | | | |
|---|---|---|---|---|
| 5,866,216 | A * | 2/1999 | Flasher | D04C 1/02 428/36.1 |
| 8,910,554 | B2 * | 12/2014 | Kinugasa | D04C 1/06 87/9 |
| 10,167,581 | B2 * | 1/2019 | Fathallah | D04C 1/06 |
| 10,202,714 | B2 * | 2/2019 | Fathallah | D04C 1/06 |
| 2002/0168488 | A1 | 11/2002 | Gladfelter et al. | |
| 2003/0135265 | A1 * | 7/2003 | Stinson | A61F 2/90 623/1.16 |
| 2008/0228028 | A1 * | 9/2008 | Carlson | A61F 2/07 600/36 |
| 2010/0030321 | A1 * | 2/2010 | Mach | A61F 2/07 623/1.18 |
| 2014/0220276 | A1 | 8/2014 | Gao et al. | |
| 2016/0122916 | A1 * | 5/2016 | Fathallah | D04C 1/06 87/9 |
| 2017/0121868 | A1 * | 5/2017 | Zhang | D03D 3/02 |
| 2017/0121871 | A1 * | 5/2017 | Krauser | D04C 1/02 |
| 2017/0137978 | A1 * | 5/2017 | Gao | D04C 1/06 |
| 2017/0207005 | A1 * | 7/2017 | Khosroshahi | H01B 7/18 |
| 2018/0057982 | A1 * | 3/2018 | Qiu | D04C 1/02 |

* cited by examiner

FIG. 1
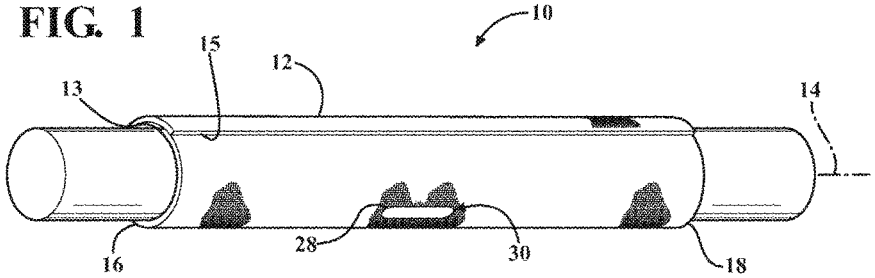
FIG. 1A
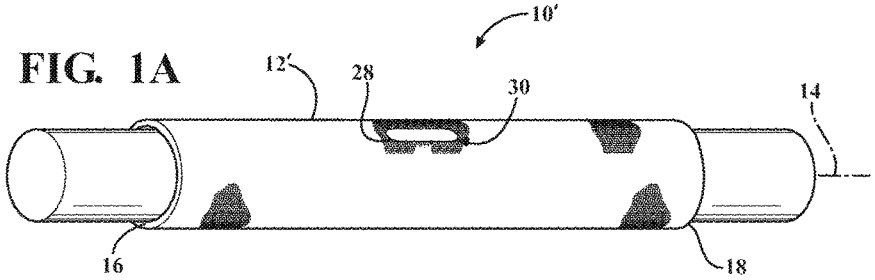
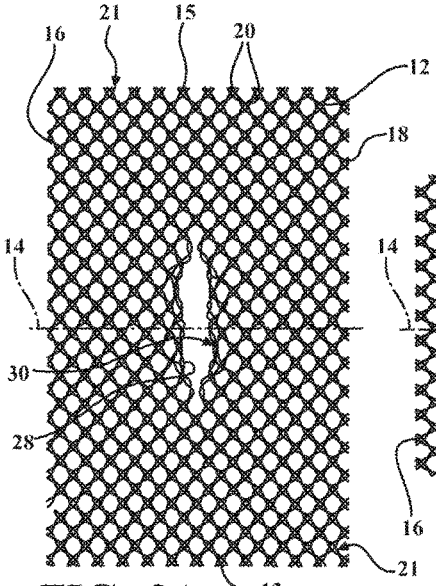
FIG. 2A
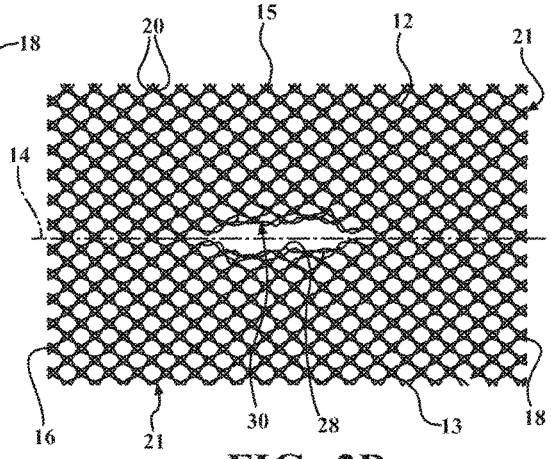
FIG. 2B

BRAIDED TEXTILE SLEEVE WITH INTEGRATED OPENING AND SELF-SUSTAINING EXPANDED AND CONTRACTED STATES AND METHOD OF CONSTRUCTION THEREOF

CROSS-REFERENCE TO RELATED APPLICATION

This application claims the benefit of U.S. Provisional Application Ser. No. 62/248,888, filed Oct. 30, 2015, which is incorporated herein by reference in its entirety.

BACKGROUND OF THE INVENTION

1. Technical Field

This invention relates generally to textile sleeves, and more particularly to braided textile sleeves.

2. Related Art

It is known to protect elongate members in textile sleeves against a variety of environmental conditions and affects, or to just contain elongate members in textile sleeves for bundling and routing purposes, such as in knit, woven or braided sleeves. In the case of braided sleeves, the braided wall is commonly braided as a circumferentially continuous, seamless wall, sometimes referred to as a 'closed' wall. One known advantage of a closed, braided wall construction is that the wall can be circumferentially expanded to facilitate sliding the wall over an elongated member by manually pushing and physically holding the opposite ends of the wall in a compressed fashion. By pushing the opposite ends toward one another and manually holding the wall in an axially compressed state, the braided wall is caused to take on an increased diameter and a reduced length. When in the increased diameter state, the wall can be readily disposed over the elongate member. Then, after sleeve is installed over the elongate member, the installer can release the wall and the opposite ends automatically spring axially away from one another, thereby taking on a circumferentially decreased diameter and increased length.

Although the aforementioned ability to increase and decrease the diameter of a braided wall has an advantage over some other known types of sleeve construction, such as woven sleeves, it does come with potential drawbacks. Namely, the ability to manually increase the diameter of the braided sleeve requires applying a continual, externally applied compression force during installation, which can prove challenging, and thus, can complicate the ability of the installer to readily install the sleeve over the elongate member. Further complicating installation of a braided sleeve arises when the sleeve has a relatively long length. With the sleeve having a relatively long length, difficultly arises by having to axially compress the opposite ends toward one another without causing the sleeve to fold or buckle along the length of the sleeve. In addition, upon releasing the wall to have the sleeve resume its lengthened, decreased diameter state, the wall generally has a tendency to spring back, at least partially, toward its axially compressed configuration due to a pattern retention phenomenon caused by friction between the interlaced yarns. As such, the effective length of the sleeve can be unintentionally decreased.

It is further known to stretch, cut or tear openings in a sidewall of the sleeve to provide access for branches of wires and branched wire connections, such as with Y or T-shaped connectors. Unfortunately, stretching yarns to form openings is time consuming and can result in inadvertently breaking yarns, while cutting the sidewall typically results in frayed, loose yarns, which not only appear unsightly, but can also diminish the useful life of the sleeve by allowing the opening to become enlarged over time, thereby subjecting the contents to contamination. It is further known to bundle branches and branched connections with multiple sleeves, thereby avoiding having to form openings in a sleeve wall, and further, to use tape about the branches. Although this can prove useful, it is time consuming, cumbersome, and as discussed above, can result in an unappealing appearance, particularly if the tape comes loose. In addition, increased cost is generally associated with having to use multiple sleeves and/or tape.

SUMMARY OF THE INVENTION

In accordance with one aspect of the invention, a protective textile having at least one integrated opening is provided. The sleeve includes a braided, tubular wall extending lengthwise in relation to a central longitudinal axis between opposite ends. The wall has a first state with a decreased length, increased cross-sectional area and a second state with an increased length, decreased cross-sectional area, as viewed in cross-section taken generally transversely to the central longitudinal axis. The wall further includes braided, heat-set yarns imparting a bias on the wall, wherein the bias causes the wall to remain substantially in the first and second states absent some externally applied force. In addition, the wall includes at least one opening having a circumferentially continuous periphery bounding the opening, wherein the periphery is formed, at least in part, by braided yarns reversing direction from one S or Z helical direction to the opposite S or Z helical direction.

In accordance with another aspect of the invention, the wall can include a plurality of the integrated openings.

In accordance with another aspect of the invention, the plurality of integrated openings can be formed in any desired location relative to one another along the length of the sleeve.

In accordance with another aspect of the invention, a plurality of the integrated openings can be formed in circumferentially spaced, radially coplanar relation with one another.

In accordance with another aspect of the invention, a plurality of the integrated openings can be axially spaced in axially aligned and/or circumferentially offset relation from one another.

In accordance with another aspect of the invention, the wall can be a circumferentially continuous, seamless wall.

In accordance with another aspect of the invention, the wall can have lengthwise extending opposite edges extending between the opposite ends, with the opposite edges being biased by heat-set yarn into overlapping relation with one another.

In accordance with another aspect of the invention, at least some of the heat-set yarns can be braided in bundles, wherein the bundles can include a plurality of yarns twisted with one another.

In accordance with another aspect of the invention, at least some the bundles can have loops interlinked with loops of another bundle.

In accordance with another aspect of the invention, at least some of the bundles of twisted yarn can be formed entirely of heat-set yarns.

In accordance with another aspect of the invention, at least some of the bundles of twisted yarn can include non-heat-settable yarn.

In accordance with another aspect of the invention, at least some of the bundles of twisted yarn can be formed entirely of non-heat-settable yarns.

In accordance with another aspect of the invention, the wall can include non-heat-settable yarn interlaced through loops of at least some of the bundles of twisted yarn.

In accordance with another aspect of the invention, the wall can include a plurality of non-heat-settable yarns interlaced through loops of at least some of the bundles of twisted yarn.

In accordance with another aspect of the invention, the non-heat-settable yarns interlaced through loops of at least some of the bundles of twisted yarn can be provided as bundles including a plurality of non-heat-settable yarns arranged in side-by-side relation with one another with the bundles extending through common loops with one another.

In accordance with another aspect of the invention, the wall can include bundles of heat-settable twisted yarn braided solely in a single helical direction, thereby reducing the weight and cost of material content of the sleeve.

In accordance with another aspect of the invention, at least some of the yarns can include a non-heat-settable multifilament yarn twisted or served with a heat-set monofilament yarn, thereby enhancing the coverage protection provided by the wall.

In accordance with another aspect of the invention, the wall can snap between the first and second states upon overcoming the bias imparted by the heat-set yarns.

In accordance with another aspect of the invention, the wall can have a first diameter in the reduced length first state and a second diameter in the increased length second state, wherein the first diameter is greater than the second diameter.

In accordance with another aspect of the invention, the wall can have a non-circular outer periphery, thereby allowing the wall to conform to similarly shaped, non-circular components.

In accordance with another aspect of the invention, the opposite free edges can be biased into overlapping relation with one another.

In accordance with another aspect of the invention, a method of constructing a wrappable textile sleeve is provided. The method includes braiding a plurality of yarns with one another to form a wall extending lengthwise along a central longitudinal axis with at least some of the yarns being provided as heat-settable yarns, with the wall being moveable between a decreased length, increased cross-sectional area first state and an increased length, decreased cross-sectional area second state. Further, forming the wall having at least one opening, bounded by a circumferentially continuous periphery, between opposite ends of the wall. Further yet, heat-setting the heat-settable yarns while the wall is in one of the first state and second state to impart a bias on the wall via the heat-set yarns, with the bias causing the wall to remain in each of the first and second states absent an externally applied axial force causing the wall to be moved to the other of the first or second state.

In accordance with another aspect of the invention, the method can further include braiding the wall with a lace-braiding machine.

In accordance with another aspect of the invention, the method can further include braiding the wall as a seamless, circumferentially continuous wall.

In accordance with another aspect of the invention, the method can further include braiding the wall as a substantially flat wall having opposite lengthwise extending edges.

In accordance with another aspect of the invention, the method can further include wrapping the flat wall about a mandrel and then performing the heat-setting step.

In accordance with another aspect of the invention, the method can include forming a plurality of the openings in the wall.

In accordance with another aspect of the invention, the method can include forming the plurality of the openings in circumferentially spaced, radially coplanar relation with one another.

In accordance with another aspect of the invention, the method can include forming the plurality of the openings in axially spaced relation from one another.

In accordance with another aspect of the invention, the method can include forming the plurality of axially spaced openings in axially aligned and/or circumferentially offset relation from one another.

In accordance with another aspect of the invention, the method can further include forming bundles of the yarns by twisting at least some of the yarns together and braiding the bundles with one another.

In accordance with another aspect of the invention, the method can further include forming loops in at least some of the bundles and interlinking loops from one of the bundles with loops of another of the bundles.

In accordance with another aspect of the invention, the method can further include forming at least some of the bundles including heat-settable yarns.

In accordance with another aspect of the invention, the method can further include forming at least some of the bundles entirely with the heat-settable yarns.

In accordance with another aspect of the invention, the method can further include forming all of the bundles of twisted yarns entirely with the heat-settable yarns to enhance the heat-shape retention capacity of the wall.

In accordance with another aspect of the invention, the method can further include forming the wall in its entirety with heat-settable yarns to optimize the heat-shape retention capacity of the wall.

In accordance with another aspect of the invention, the method can further include interlacing non-heat-settable yarns with at least some of the bundles of twisted yarns to enhance the coverage protection provided by the wall.

In accordance with another aspect of the invention, the method can further include interlacing non-heat-settable yarns through loops of at least some of the bundles of twisted yarns to enhance the coverage protection provided by the wall.

In accordance with another aspect of the invention, the method can further include forming at least some of the bundles including non-heat-settable yarn to enhance the coverage protection of the sleeve.

In accordance with another aspect of the invention, the method can further include forming at least some of the bundles including a plurality of non-heat-settable yarns arranged in side-by-side, non-twisted relation with one another to enhance the coverage protection of the sleeve.

In accordance with another aspect of the invention, the method can further include extending the bundles of non-heat-settable yarns arranged in side-by-side relation with one another through common loops of other bundles of twisted yarns to enhance the coverage protection of the sleeve.

In accordance with another aspect of the invention, the method can further include forming at least some of the bundles including heat-settable yarns twisted with non-heat-settable yarns to enhance the coverage protections provided by the wall.

BRIEF DESCRIPTION OF THE DRAWINGS

These and other aspects, features and advantages of the present invention will become more readily appreciated when considered in connection with the following detailed description of presently preferred embodiments and best mode, appended claims and accompanying drawings, in which:

FIG. 1 is a schematic perspective view of a wrappable sleeve constructed in accordance with one aspect of the invention shown disposed about an elongate member to be protected;

FIG. 1A is a schematic perspective view of a circumferentially continuous, seamless sleeve constructed in accordance with another aspect of the invention shown disposed about an elongate member to be protected;

FIG. 2A is a schematic plan view of the wrappable sleeve of FIG. 1 shown in a flattened, unwrapped, axially compressed, decreased length first state;

FIG. 2B is a schematic plan view of the wrappable sleeve of FIG. 1 shown in a flattened, unwrapped, axially expanded, increased length second state;

DETAILED DESCRIPTION OF PRESENTLY PREFERRED EMBODIMENTS

Figure 3:
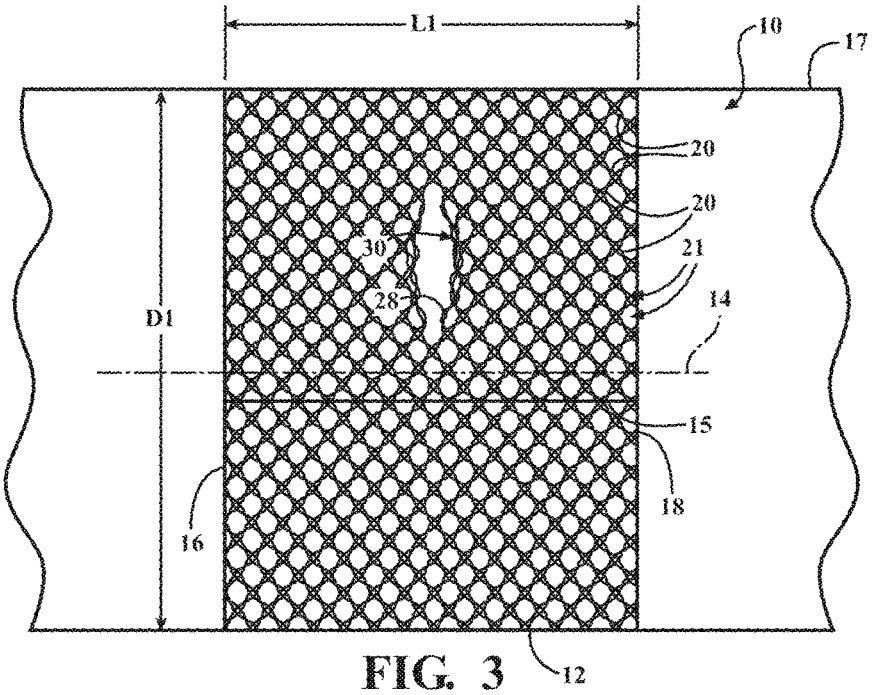
FIG. 3 is a schematic side view of the wrappable sleeve of FIG. 1 constructed in accordance with one embodiment of the invention shown wrapped about a mandrel in the axially compressed, reduced length first state.

Referring in more detail to the drawings, FIGS. 1, 3, 4A-4B illustrate a wrappable, braided protective textile sleeve, referred to hereafter as sleeve 10, constructed in accordance with one aspect of the invention, and FIGS. 1A, 3A, 5A-5B illustrate a circumferentially continuous, seamless, braided protective textile sleeve, referred to hereafter as sleeve 10', constructed in accordance with another aspect of the invention. The primary difference between the two sleeves 10, 10' is that the sleeve 10 has a wrappable wall 12, while the sleeve 10' has a seamless tubular wall 12'. Otherwise, the sleeves 10, 10' have similar features which are identified by the same reference numerals hereafter, unless otherwise noted.

The circumferentially discontinuous wall 12 has opposite free edges 13, 15 extending lengthwise in generally parallel relation to a central longitudinal axis 14 between opposite open ends 16, 18, while the seamless wall 12' also extends along a longitudinal axis 14 between opposite ends 16, 18. The walls 12, 12' are axially compressible to attain a pre-assembled first state, having a decreased length L1 and increased diameter D1 and/or increased cross-sectional area, as viewed in lateral cross-section taken generally transversely to the central longitudinal axis 14 (respective FIGS. 4A and 5A), and are axially extendible to attain a fully assembled second state, having an increased length L2 and decreased diameter D2 and/or decreased cross-sectional area (respective FIGS. 4B and 5B). The walls 12, 12' include heat-settable, braided yarn 20, which upon being heat-set, causes at least a portion of the wall 12, 12', in which the heat-set yarn 20 is contained, to remain in, or substantially in, a selected one of the first and second states absent some externally applied force, wherein the externally applied force can be selectively applied to overcome the bias, thereby axially contracting and extending the wall 12, 12' between the first and second states, as desired. The heat-set yarn 20 imparts a bias on the wall 12, 12' and upon overcoming the bias via the externally applied force, the wall 12, 12' then remains in the newly selected state, whether the first or second state, until the wall 12, 12' is further acted on by a suitable external force to again move the wall 12, 12' to a different stable configuration, whereupon the wall 12, 12' remains substantially in the new stable configuration until acted on by a suitable external force. Accordingly, the wall 12, 12' has bi-stable, self-sustaining axially compressed first and axially extended second states, though it should be recognized that the wall 12, 12' is able to be readily manipulated to take-on multi-stable configurations as a result of being able to manipulate as many discrete regions of the wall 12, 12' between the opposite ends 16, 18 between the first and second states as desired.

The wall 12 is preferably braided on a lace-braiding machine as a circumferentially continuous tube, or as a flat layer, though other braiding mechanisms are contemplated herein. If braided as a circumferentially continuous tube, the tube is subsequently cut lengthwise, such as via a hot knife, blade or wire, by way of example and without limitation, to form the opposite, lengthwise extending edges 13, 15. The lengthwise cutting process can be performed after cutting the tubular wall 12 to the desired length of the finished sleeve 10, or alternately, the tubular wall 12 can be cut lengthwise prior to cutting the tubular wall 12 lengthwise to form the opposite edges 13, 15. In addition, regardless of when the circumferentially continuous, tubular wall 12 is cut lengthwise, the wall 12 can be heat-set while in the decreased length L1 and increased diameter D1 and/or increased cross-sectional area first state either prior to cutting the wall 12 lengthwise, or after. Otherwise, if the wall 12 is formed as a flat layer, the flat layer is subsequently wrapped about a mandrel 17 (FIG. 3), preferably with the opposite edges 13, 15 being brought into overlapping relation with one another and preferably while in the decreased length L1 and increased diameter D1 and/or increased cross-sectional area first state, and then the wall 12 is heat-set about the mandrel 17. With regard to the seamless wall 12', it too is preferably braided on a lace-braiding machine as a circumferentially continuous tube, though other braiding mechanisms are contemplated herein.

In accordance with one aspect of the invention, the yarn of the walls 12, 12', whether provided entirely or only partially from heat-settable yarns, can be braided, at least in part, as bundles 21 of yarn, wherein the bundles 21 include a plurality of ends of yarn that can be twisted with one another, one yarn in an S-direction and the other yarn in a Z-direction, thereby allowing the separate bundles 21 of yarn to be braided as a single yarn. The walls 12, 12' can be constructed, at least in part, with individual bundles 21 braided with one another, with each bundle 21 including a plurality, shown as a pair of yarns (FIG. 6), twisted with one another. It should be recognized that more than 2 ends of yarn could be bundled with one another if desired for the intended application. The individual bundles 21 of twisted yarns can be braided in a single S or Z direction or in both S and Z directions (with S representing a first helical direction and Z representing an opposite helical direction). The bundles 21 are shown as being interlinked with one another at cross-over locations by interlinked, circumferentially closed openings or loops 22 formed within each of the respective twisted pairs of yarns 21, and thus, the individual pairs of bundled yarns 21 are effectively interlinked and locked together such that they are inseparable from one another. The interlinking of the loops 22 greatly enhances the effect of the bias imparted in the heat-set yarns 20 to move the walls 12, 12' between the first and second bi-stable states and maintain the walls 12, 12' or portion of the walls 12, 12' in the selected state; however, it is contemplated herein that the yarns could be braided without being linked together, though it is with the understanding that the stable states discussed above are likely to be much less pronounced.

Figure 3A:
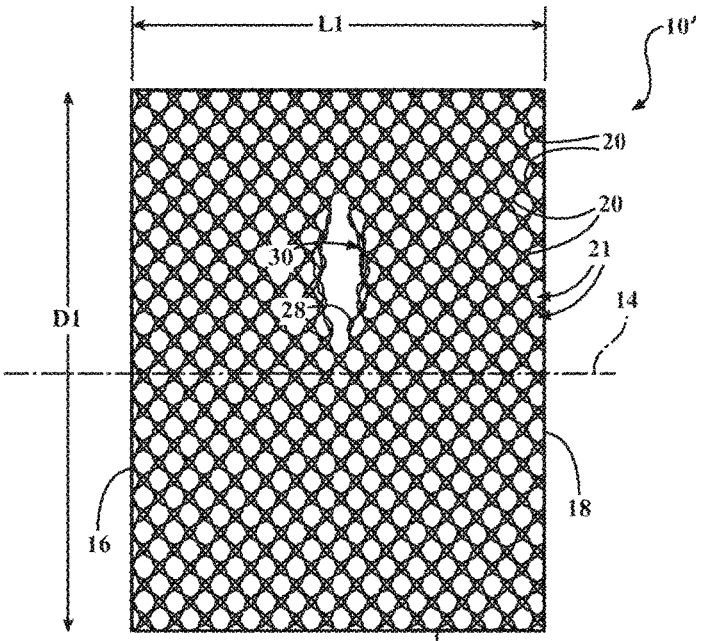
FIG. 3A a schematic side view of the sleeve of FIG. 1A shown in an axially compressed, reduced length first state.

Upon braiding the walls 12, 12', as discussed above, the heat-settable yarn 20, which can be provided as a heat-settable monofilament or a heat-settable multifilament, such as from nylon, polyphenylene sulfide (PPS), polyethylene-terephthalate (PET), or polypropylene (PP), having a diameter between about 0.1-0.40 mm, by way of example and without limitation, is then heat-set while the walls 12, 12' are in a selected configuration, such as in a fully or at least partially axially compressed, reduced length state (FIGS. 3, 3A). As mentioned, if the wall 12 is constructed as a seamless, tubular wall 12, the heat-setting process can be performed prior to, or after cutting the wall 12 lengthwise to form the opposite edges 13, 15; however, if performed after cutting the wall 12, the opposite edges 13, 15 can be wrapped into overlapping relation similar, as performed for the flat layer, thereby acting to provide an enhanced overlap of the opposite edges 13, 15 after heat-setting by heat-setting the heat-settable yarn 20 to be biased into a circumferentially extending configuration, thereby rendering the wall 12 self-wrapping. It should be further noted that if the wall 12 is formed as a seamless, circumferentially tubular wall, the lengthwise cutting process results in the opposite edges 13, 15 having cut yarns, though, it is contemplated that if cut with a heated blade or wire, the yarns could be fused to one another at the cut edges 13, 15, thereby acting to prevent fraying. Otherwise, if braided as a flat wall 12 (FIGS. 2A and 2B), the yarns can be braided to reverse helical direction, from S to Z and/or vice versa, at one or both of the edges 13, 15, thereby forming the edges 13, 15 with enhanced, fray resistant integrity and smoothness.

Figure 6:
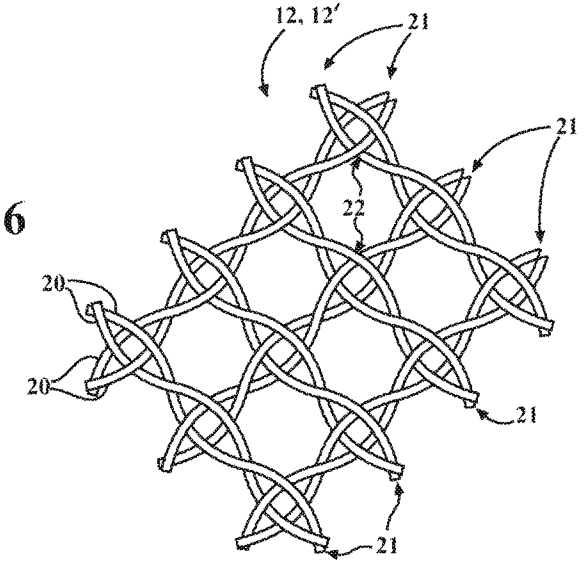
FIG. 6 is an enlarged fragmentary view of a wall of the sleeve of FIGS. 1 and 1A.

For maximum spring bias between the reduced length L1, increased cross-sectional area first state and increased length L2, decreased cross-sectional area second state, the entirety of the walls 12, 12' can be formed from twisted bundles of heat-settable monofilaments 20, such as shown in FIG. 6, by way of example and without limitation, though, if desired to provide additional types of protection other than abrasion, such as, enhanced coverage, thermal, acoustic or electromagnet interference (EMI), for example, at least some of the yarns can be provided as non-heat-settable yarn, discussed in further detail below. As such, the individual twisted bundles 21 could have a desired number of heat-settable ends of yarn 20 and a desired number of non-heat-settable ends of yarn, as long as enough heat-settable yarns 20 are included to impart the bias necessary to maintain the wall 12, 12' in its first and second positions. If the walls 12, 12' includes a relatively low percentage of heat-settable yarns 20 relative to the content of non-heat-settable yarns, such less than 50% content, by way of example and without limitation, the diameter of the heat-settable yarns 20 can be increased, thereby being at the upper limit of the diameter range, to impart an increased bias as compared to if the heat-settable yarns 20 were provided toward the lower limit of the diameter range.

Figure 4A:
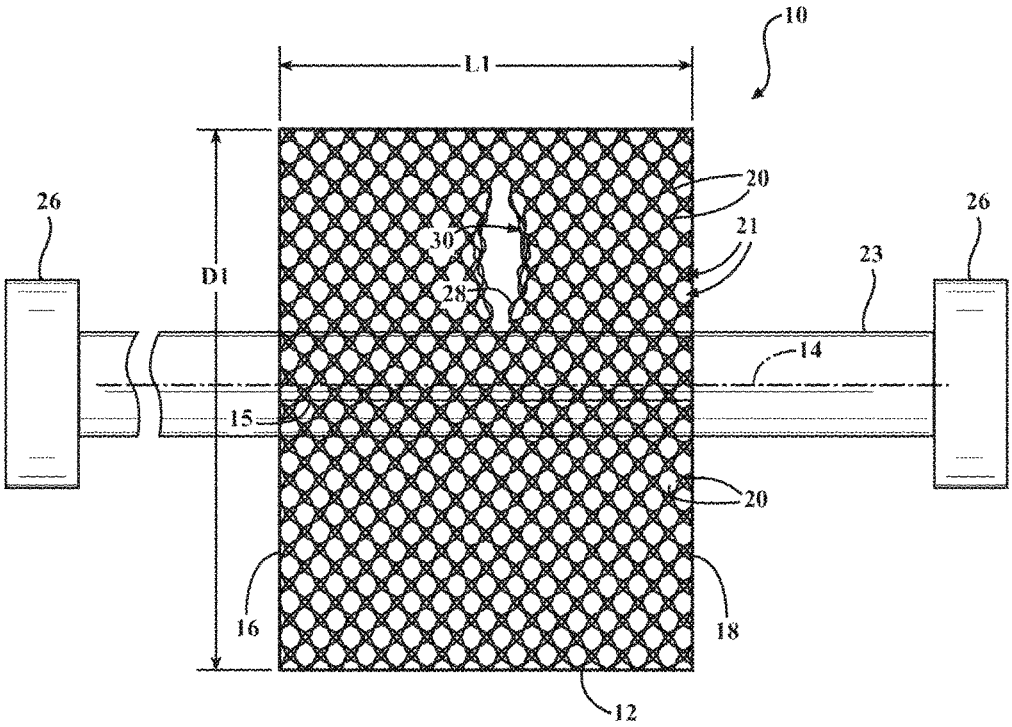
FIG. 4A is a schematic side view of the sleeve of FIG. 1 shown disposed about an elongate member to be protected while in the axially compressed, reduced length first state.
Figure 4B:
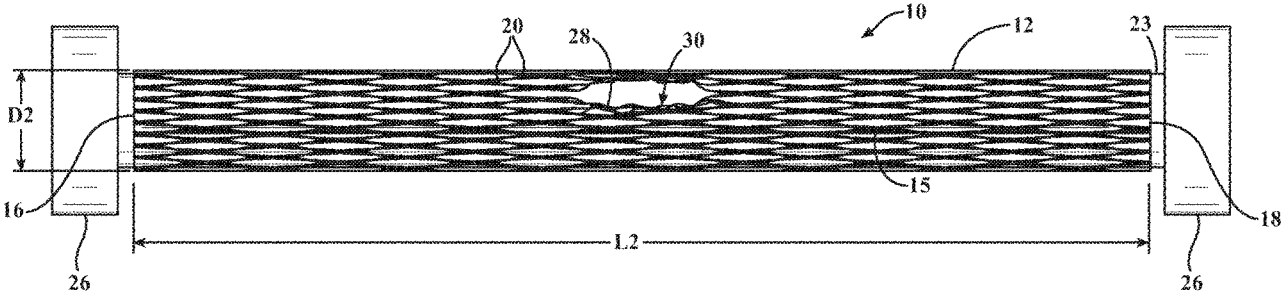
FIG. 4B is a schematic side view of the sleeve of FIG. 1 shown disposed about the elongate member to be protected in an axially extended, increased length second state.
Figure 5A:
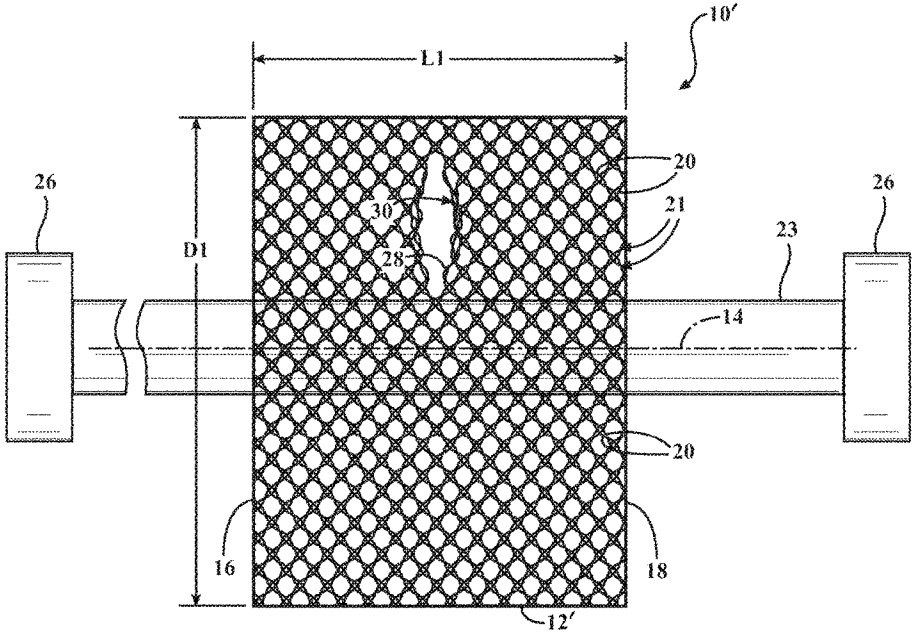
FIG. 5A is a schematic side view of the sleeve of FIG. 1A shown disposed about an elongate member to be protected while in the axially compressed, reduced length first state.
Figure 5B:
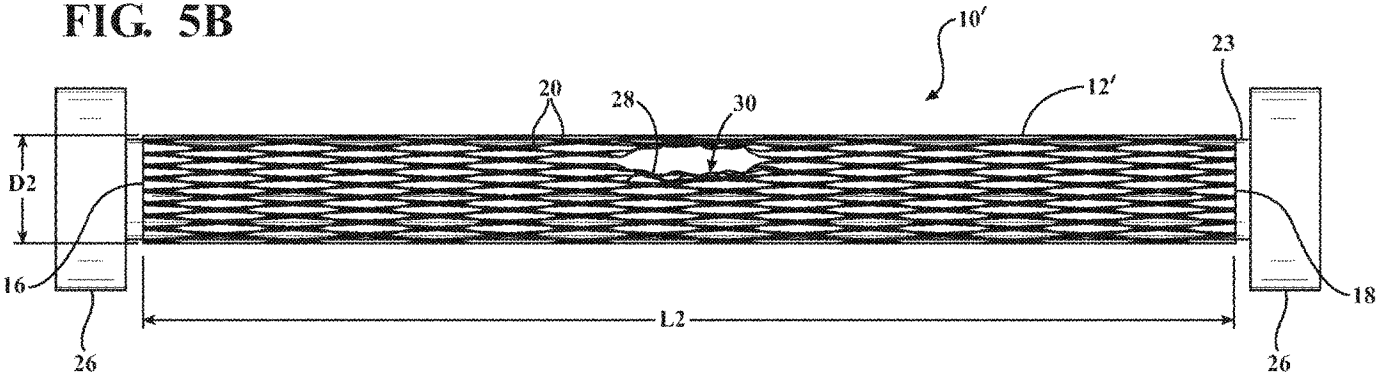
FIG. 5B is a schematic side view of the sleeve of FIG. 1A shown disposed about the elongate member to be protected in an axially extended, increased length second state.

As discussed above, prior to heat-setting the heat-settable yarn 20, the opposite ends 16, 18 of the walls 12, 12' are axially compressed toward one another until the walls 12, 12' are brought to a radially expanded, increased diameter D1 and/or increased cross-sectional area (the area bounded by the walls 12, 12' as viewed in lateral cross-section taken generally transversely to the central longitudinal axis 14), reduced length L1, first state, and then a suitable degree of heat is applied to the heat-settable yarn 20, thereby causing the heat-settable yarn 20 to take-on a heat-set. Upon being heat-set, aside from the wall 12 having its opposite edges 13, 15 biased into overlapping relation with one another to render the wall 12 as a self-wrapping wall (if heat-set while the opposite edges 13, 15 are in overlapping relation with one another), the walls 12, 12' attain a bias imparted by the heat-set yarn 20 that tends to maintain the walls 12, 12' in the selected in-use second state configuration having an axially extended length L2, reduced diameter D2 and/or reduced cross-sectional area (FIGS. 1, 1A, 4B, 5B) or the in the pre-assembly first state configuration having an axially reduced length L1, radially expanded diameter D1 and/or increased cross-sectional area (FIGS. 4A, 5A). Regardless of which state the sleeve 10, 10' is in, the sleeve 10, 10' remains in that state until a sufficient externally applied, axial force is applied to overcome the bias imparted by the heat-set yarn 20. When a suitable force is applied to the wall 12, 12', generally along the direction central longitudinal axis 14 of the sleeve 10, 10', the portion or section of the wall 12,12' acted on by the axial force snaps, springs, causes the wall 12, 12' to move from one state to the other, whereupon the wall 12, 12' remains in the altered state until acted on again by a suitable external, axially applied force, whether going from the first state to the second state, or vice versa. As such, it should be recognized, the entire length of the wall 12, 12' can be formed into one of the decreased length, first state or increased length, second state, or any number of discrete lengthwise extending portions or segments of the wall 12, 12' can be manipulated to change between the aforementioned first and second states, as desired. Accordingly, axially extending segments of the wall 12, 12' adjacent one another can be biased to remain in different ones of the first and second states from one another, if desired, thereby allowing the wall 12 to take on a varying outer profile along its length.

Figure 11:
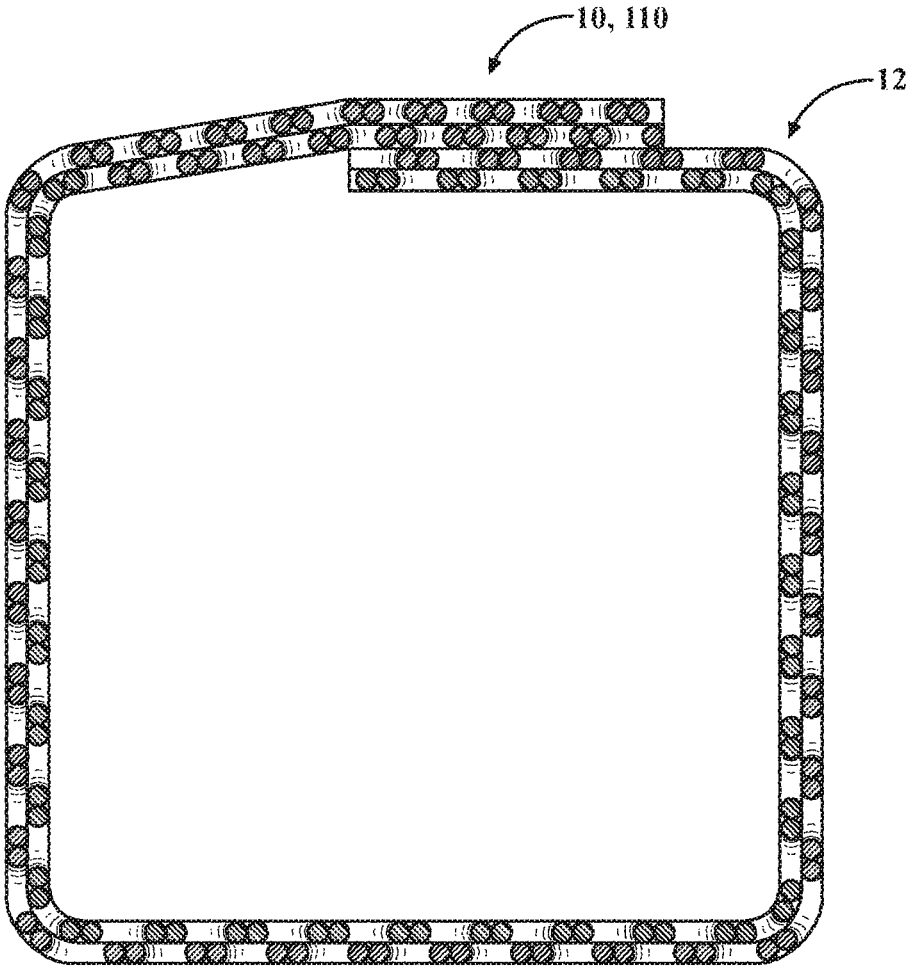
FIG. 11 is a cross-sectional view of a wrappable sleeve constructed in accordance with yet another aspect of the invention.
Figure 11A:
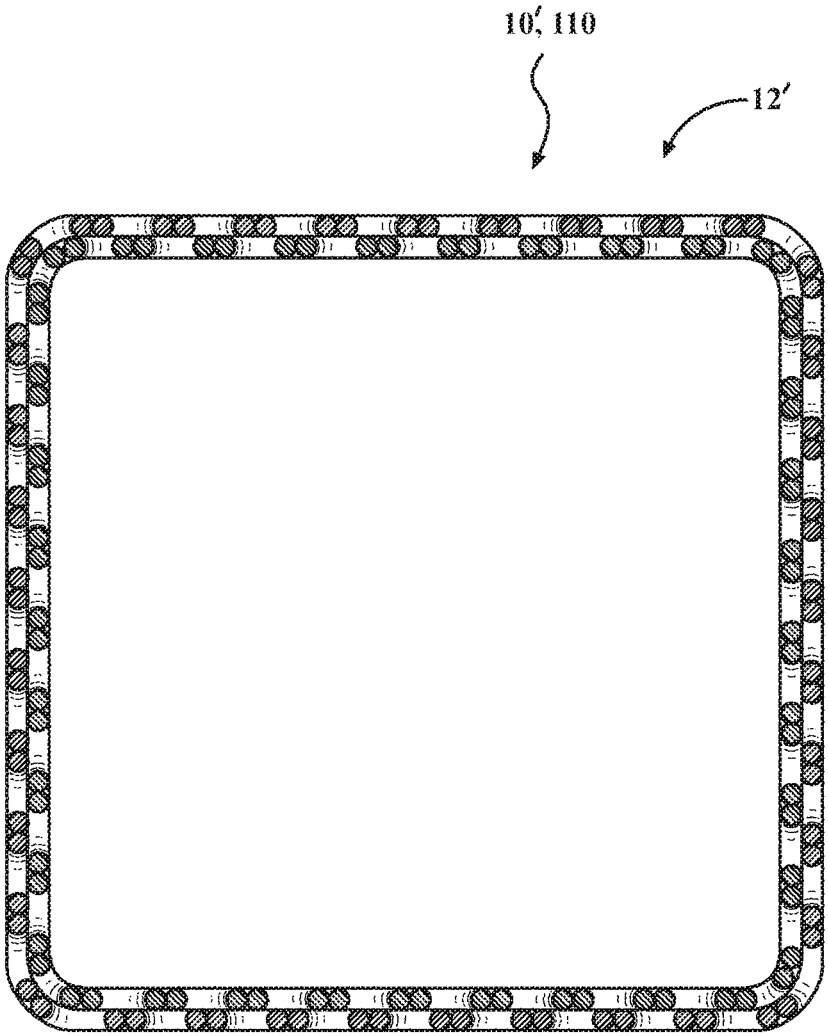
FIG. 11A is a cross-sectional view of a seamless sleeve constructed in accordance with yet another aspect of the invention.

Prior to the heat-setting step, the wall 12, 12' of the sleeve, while being compressed axially to the reduced length L1, first state, the outer periphery of the wall 12, 12' can be shaped to be other than circular. Accordingly, the outer periphery can be formed into a non-circular shape as viewed in lateral cross-section taken generally transversely to the central longitudinal axis 14. The non-circular shape can be any desired shaped as may be beneficial for the particular end-use application, such as square, rectangular, triangular, or any polygonal, non-circular shape. Then, upon forming the wall 12, 12' into the reduced length L1, first state, and upon configuring the outer periphery of the wall 12, 12' into the desired cross-sectional shape, the heat can be applied to the wall 12, 12' to impart the heat-set into the heat-settable yarn 20, thereby providing the wall 12, 12' with the bi-stable functionality, as well as forming the outer periphery into the selected shape, whether circular or non-circular (FIGS. 11 and 11A), as viewed in lateral cross-section.

During assembly of the sleeve 10, 10' about an elongate member 23 to be bundled and protected, such as a wire harness, conduit, or otherwise, the wall 12, 12' can be axially compressed along its central longitudinal axis 14 to a fully or partially compressed first state (FIGS. 4A, 5A), wherein the wall 12, 12' remains in, or substantially in the first state absent some externally applied forced sufficient to move the wall 12, 12' to a different configuration. If the wall 12, 12' is relatively long, such as about 2 ft or longer, separate lengthwise extending regions can be axially compressed until the entire wall 12, 12' is axially compressed at least in part, thereby making it easy to transform the entire length of the wall 12, 12' to the first, axially compressed state. As such, the sleeve 10, 10' takes on an increased diameter D1 and/or increased cross-sectional area, which allows the wall 12 to be more easily and readily opened, via spreading the opposite edges 13, 15 away from one another, and in general allowing the wall 12, 12' to be more readily disposed about the elongate member 23 to be protected, as well as about any enlarged connectors or fittings 26 attached thereto. Then, upon disposing the radially expanded wall 12, 12' about the elongate member 23, an axially applied tensile force can be applied to the wall 12, 12', such as by pulling at least one of the opposite ends 16, 18 axially away from the other of the opposite ends 16, 18, thereby causing the wall 12, 12' to extend axially and snap or spring from the radially expanded, reduced length first state to the radially contracted, increased length second state, such as shown schematically in FIGS. 4B and 5B, by way of example and without limitation. It should be recognized that any portion or portions of the wall 12, 12' can be lengthened from the reduced length state L1, as desired, while leaving the remaining portion or portions in the first, axially compressed, radially expanded state if desired. As such, the wall 12, 12', which can be braided to extend over any desired axial length, can be extended axially over the desired length of the elongate member 23 to be protected. With the wall 12, 12' being moved to the increased length L2, reduced diameter D2 and/or reduced cross-sectional area second state, the wall 12, 12' is able to contain the elongate member 23, such as a wire harness, for example, in the desired envelope to allow the elongate member 23 to be neatly bundled and routed, as desired. Further, in addition to the braided wall 12, 12' acting to bundle the elongate member 23, particularly in the case of a wire harness having a plurality of individual, exposed wires, the wall 12, 12' acts to provide protection to the elongate member 23 against abrasion, particularly if the heat-settable yarn 20 is provided as a monofilament. It should be recognized that the picks per inch can be provided, as desired, to provide the coverage needed for the intended application. As such, if less coverage is needed, a reduced picks per inch can be used, and if more coverage is needed, and increased picks per inch can be used. Further yet, the picks per inch can be varied over the length of the wall 12, 12', as desired for the intended application. With less coverage, a benefit of seeing through the wall 12, 12' is attained, thereby being able to see the contents within the sleeve, such as individual colors of separate wires, by way of example and without limitation. Otherwise, if provided with increased coverage, added protection against the ingress of contamination or enhanced acoustic and/or thermal protection can be provided.

Figure 7A:
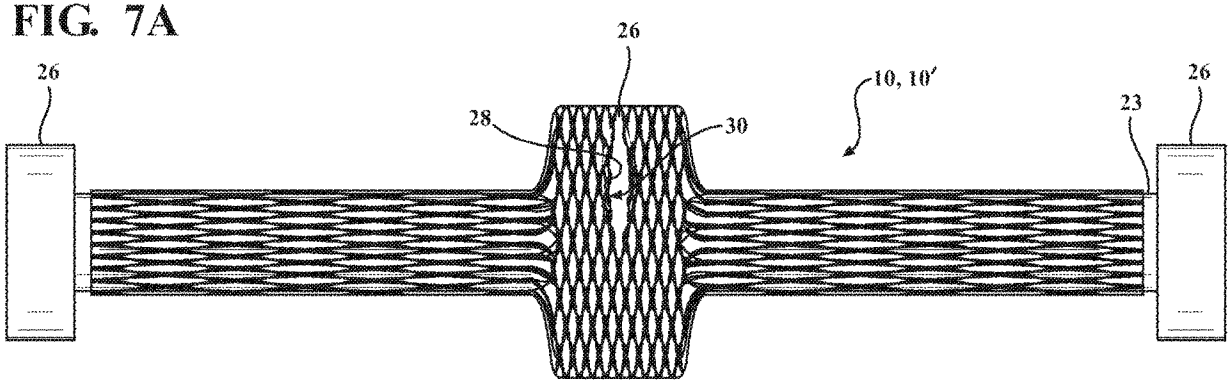
FIG. 7A is a view similar to FIGS. 4B and 5B showing the sleeves of FIGS. 1 and 1A disposed about an elongate member having a centrally located connector.
Figure 7B:
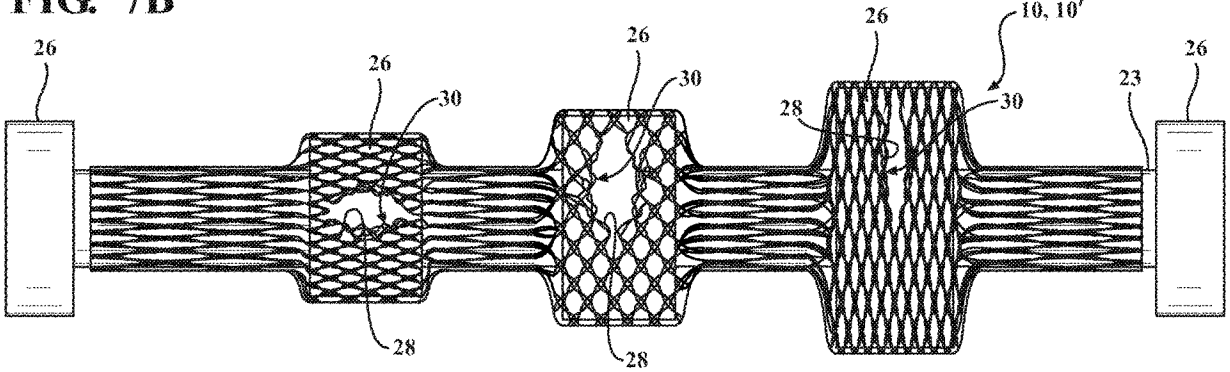
FIG. 7B is a view similar to FIG. 7A showing the sleeves of FIGS. 1 and 1A disposed about an elongate member having a plurality of intermediately located connectors.

In FIG. 7A, the sleeve 10, 10' is shown extending about an elongate member 23 having a centrally located connector 26 between opposite end connectors 26. The ability of the sleeve 10, 10' to remain expanded locally in the first state over a portion of the length of the sleeve 10, 10' allows the wall 12, 12' to accommodate the central connector 26, wherein the remaining portion of the sleeve 10, 10' can be readily extended lengthwise to the second state upon assembly. It should be recognized that any number of expanded regions in the first state and contracted regions in the second state can be formed between the opposite ends 16, 18 of the sleeve 10, 10', as desired, such as shown in FIG. 7B, wherein the elongate member 23 includes a plurality of intermediate connectors 26 to be received within the sleeve 10, 10', thereby allowing the sleeve 10, 10' to accommodate and conform to a multitude of different radial dimensions and undulations of the elongate member 23 along the length of the sleeve 10, 10'.

Figure 8:
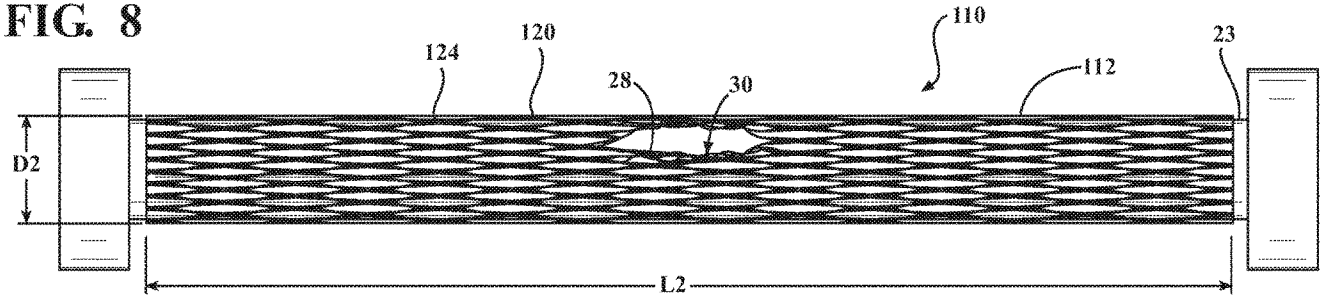
FIG. 8 is a view similar to FIGS. 4B and 5B showing a sleeve constructed in accordance with another aspect of the invention shown disposed about an elongate member to be protected.

In FIG. 8, a sleeve 110 constructed in accordance with another aspect of the invention is shown, wherein the same reference numerals as used above, offset by a factor of 100, are used to identify like features. It is to be understood that the sleeve 110 could be either a wrappable sleeve, as discussed above for the sleeve 10, or a seamless sleeve, as discussed above for the sleeve 10'. The sleeve 110 has a braided, wrappable wall, identified generically by reference numeral 112, including heat-settable yarns 120, as discussed above, wherein upon being heat-set, impart a bias on the wall 112 that causes the wall 112 to remain in selected first and second states, and can further impart a bias to bring the opposite edges of a wrappable wall into overlapping relation with one another, if heat-set while the opposite edges are in overlapped relation with one another, as discussed above. As such, absent some externally applied force causing the wall 112 to move, the wall 112 remains in a selected one of the first and second states. As discussed above, an externally applied force can be selectively applied to the wall 112, in its entirety or to a discrete region, to move the wall 112 or portion thereof from one of the first and second states to the other of the first and second states, as desired. The wall 112 of the sleeve 110 further includes non-heat-settable yarns 124 braided with the heat-settable yarns 120. The non-heat-settable yarns 124 can be provided as a multifilament yarn and/or a monofilament yarn, from various non-heat-settable materials to provide the desired type of protection, such as mineral fiber, e.g. basalt, silica, or ceramic or fiberglass, or as flexible conductive filaments, such as from wire, metal coated polymeric yarn filaments, or hybrid yarns including a conductive filament or non-conductive filament served or twisted with another yarn filament, such as a heat-settable or non-heat-settable monofilament and/or multifilament, for example. If provided as a multifilament yarn, enhanced coverage is provided to protect the elongate member 23 against contamination from external debris. Further, the multifilaments enhance the softness to the sleeve 110, thereby reducing the abrasive effects of the wall 112 against neighboring objects. A plurality of braid patterns are contemplated for the wall 112, with those embodiments discussed hereafter.

Figure 9A:
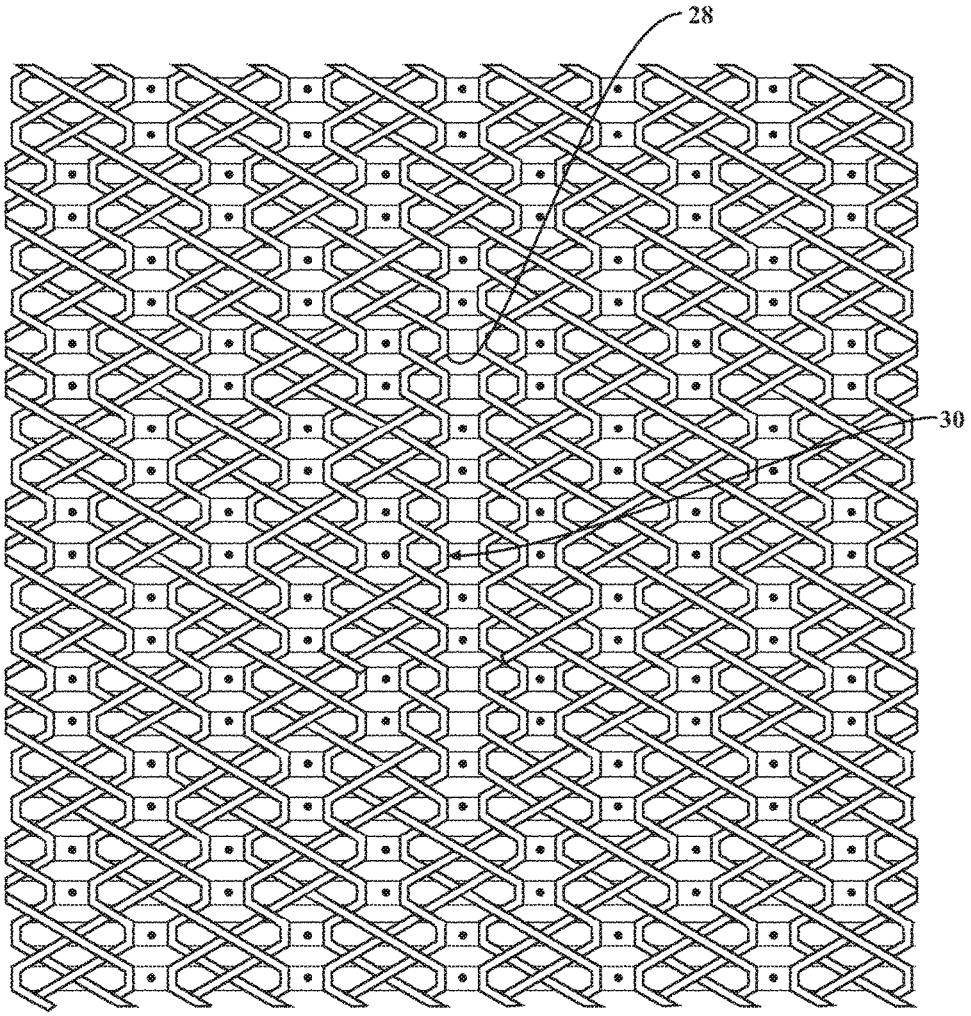
FIG. 9A is a schematic partial braid diagram illustrating an opening as formed in accordance with one embodiment in the sleeves of FIGS. 1 and 1A.
Figure 9B:
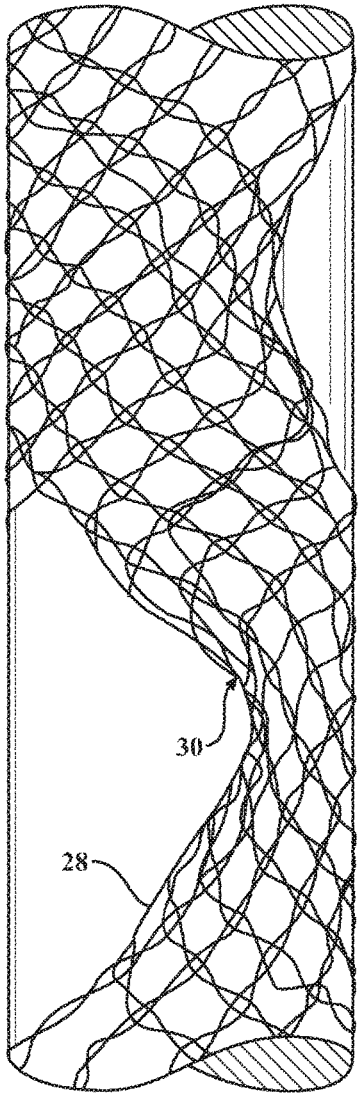
FIGS. 9B and 9C are partial side views of sleeves constructed in accordance with different aspects of the invention showing openings integrally braided therein.
Figure 9C:
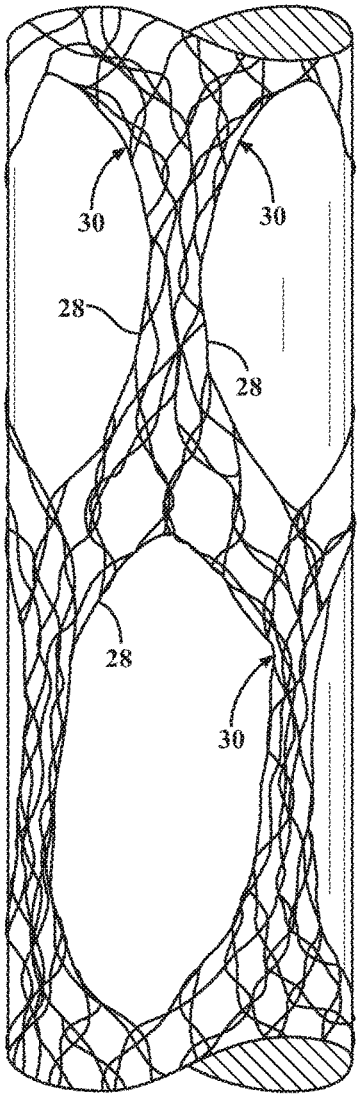

In accordance with a further aspect of the invention, the walls 12, 12', 112 are braided having an integral opening(s) 28 formed therein during the braiding process. It is to be understood the opening(s) 28 is not simply an opening formed naturally via any common braided material, but rather, is formed as a larger opening than the common, generally diamond-shaped opening formed in any typical braid, and thus, the opening (s) spans a plurality (two or more) of crossover nodes (point where S and Z direction yarns cross over/under one another) of the braided yarns. The openings 28 are formed having a circumferentially continuous periphery 30, thereby resulting in no loose, cut yarns, and further resulting in the openings 28 having structural integrity and an aesthetically pleasing appearance. The openings 28 are formed, as best shown schematically in FIG. 9A, and in FIGS. 9B and 9C, via braided yarns reversing direction from one of the S or Z helical directions to the opposite S or Z helical direction at the periphery 30 of the opening 28. Accordingly, the openings 28 are formed "as braided" and are not formed via secondary cutting processes. The openings 28 can be formed having any desired length, and can be formed in any desired location or locations along the length of the walls 12, 12', 112. Accordingly, a plurality of openings 28 can be formed in the walls 12, 12', 112, wherein the openings 28 can be arranged in axial alignment with one another; in circumferentially spaced relation from one another, whether coplanar within a plane extending substantially transversely to the central axis 14 or axially staggered from one another; in helical relation with one another, or otherwise. The openings 28 provide locations for easy access to connectors and locations through which branches of wires can be readily extended.

Figure 10A:
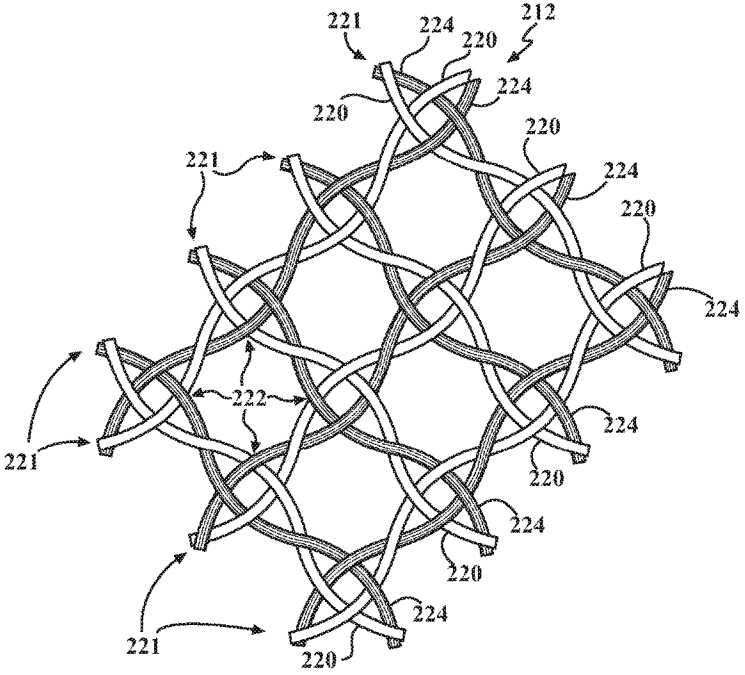
FIG. 10A is a view similar to FIG. 6 showing an enlarged fragmentary view of a wall of a sleeve constructed in accordance with another aspect of the invention.

As shown FIG. 10A, one embodiment of a wall 212 of the sleeve 110 of FIG. 8 is shown, wherein the same reference numerals as used above, offset by a factor of 200, are used to identify like features, wherein an enlarged fragmentary portion of the wall 212 is shown for simplicity, with it being understood that the remaining portion of the wall 212 is the same. The wall 212 includes the non-heat-settable yarns 224, which are shown as being bundled in twisted relation with the heat-settable yarns 220 to form discrete bundles 221, shown as a single non-heat-settable yarn 224 being twisted with a single heat-settable yarn 220, by way of example and without limitation. The discrete bundles 221 are braided with one another to form the entirety of the wall 212, with each of the loops 222 of each bundle shown as being interlinked with loops 222 of another bundle 221, in accordance with another aspect of the invention. As such, each of the bundles 221 provide a dual benefit of being able to impart a bias upon the heat-settable yarn 220 being heat-set, while each bundle also provides enhanced coverage protection via inclusion of a non-heat-settable yarn 224, such as a relatively bulky multifilament, for example.

Figure 10B:
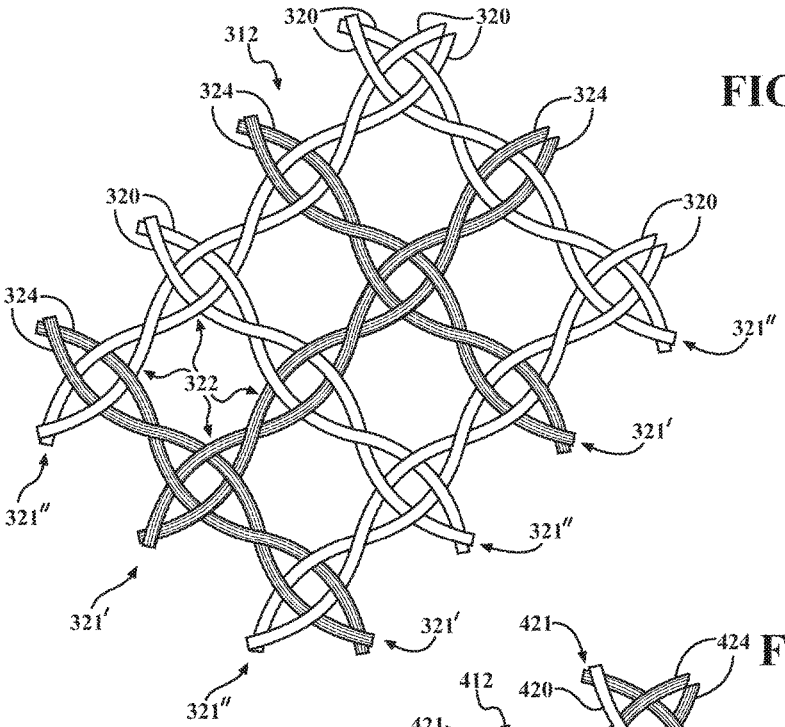
FIG. 10B is a view similar to FIG. 6 showing an enlarged fragmentary view of a wall of a sleeve constructed in accordance with yet another aspect of the invention.

In FIG. 10B, another embodiment of a wall 312 of the sleeve 110 of FIG. 8 is shown, wherein the same reference numerals as used above, offset by a factor of 300, are used to identify like features, wherein an enlarged fragmentary portion of the wall 312 is shown for simplicity, with it being understood that the remaining portion of the wall 312 is the same. The wall 312 includes the non-heat-settable yarns 324, which are shown as being bundled in twisted relation with one another to form discrete bundles 321' entirely of twisted non-heat-settable yarn, wherein the discrete bundles 321' can be braided with other bundles 321" containing heat-settable yarn 320, such as bundles of solely heat-settable yarn 320, with each of the loops 322 of each bundle 321', 321" shown as being interlinked with loops 322 of another bundle 321', 321", in accordance with another aspect of the invention. The twisted bundles 321' of non-heat-settable yarn 324 and twisted bundles 321" of heat-settable yarn 320 are shown as alternating with one another in each of the S and Z directions.

Figure 10C:
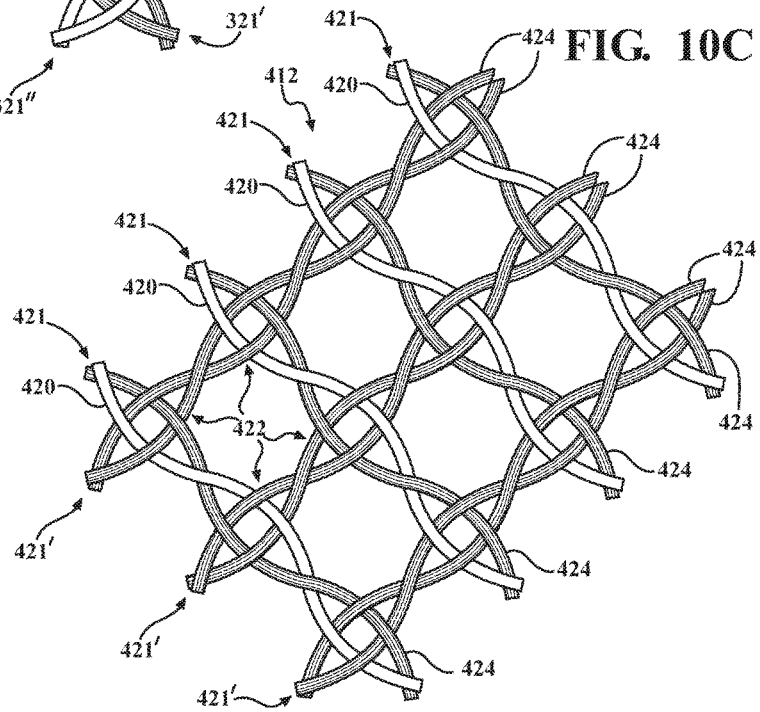
FIG. 10C is a view similar to FIG. 6 showing an enlarged fragmentary view of a wall of a sleeve constructed in accordance with yet another aspect of the invention.

In FIG. 10C, another embodiment of a wall 412 of the sleeve 110 of FIG. 8 is shown, wherein the same reference numerals as used above, offset by a factor of 400, are used to identify like features, wherein an enlarged fragmentary portion of the wall 412 is shown for simplicity, with it being understood that the remaining portion of the wall 412 is the same. The wall 412 includes the bundles 421' containing solely non-heat-settable yarn 424, wherein the discrete bundles 421' can be braided with other bundles 421 containing both heat-settable yarn 420 and non-heat-settable yarn 424, with each of the loops 422 of each bundle 420, 421' shown as being interlinked with loops 422 of another bundle 420, 421'. In this embodiment, the bundles 421 are shown as extending entirely in a first S or Z helical direction, while the bundles 421' are shown as extending entirely in an opposite second S or Z helical direction relative to the bundles 421. Accordingly, the use of the heat-settable yarns 420 is reduced, thereby adding to the degree of coverage provided by the non-heat-settable yarn 424, and further increasing the degree of flexibility of the sleeve 110.

Figure 10D:
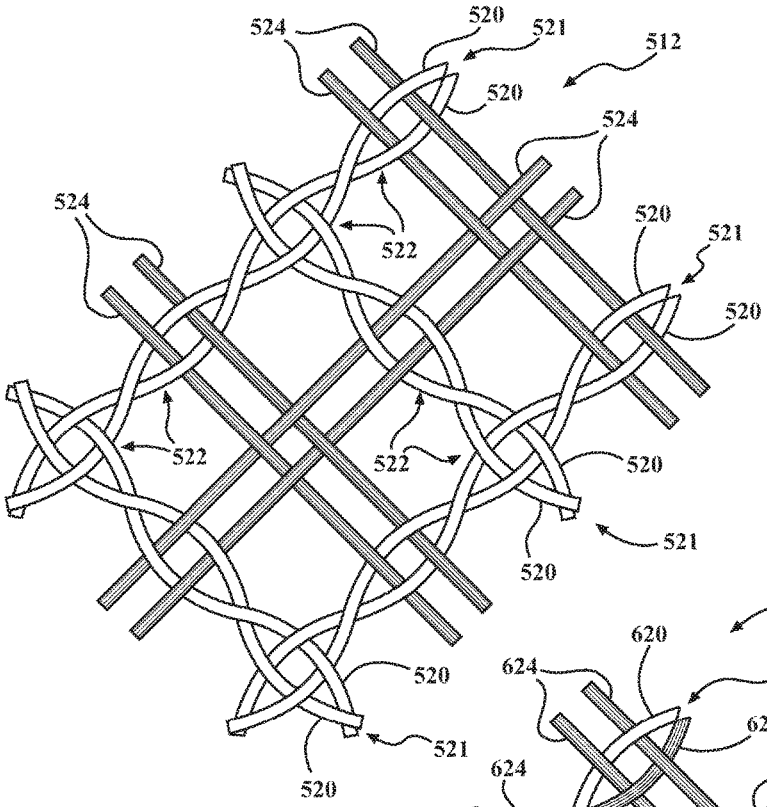
FIG. 10D is a view similar to FIG. 6 showing an enlarged fragmentary view of a wall of a sleeve constructed in accordance with yet another aspect of the invention.

In FIG. 10D, another embodiment of a wall 512 of the sleeve 110 of FIG. 8 is shown, wherein the same reference numerals as used above, offset by a factor of 500, are used to identify like features, wherein an enlarged fragmentary portion of the wall 512 is shown for simplicity, with it being understood that the remaining portion of the wall 512 is the same. The wall 512 includes the twisted bundles 521 containing solely heat-settable yarn 520, with the bundles 521 shown as extending in both the S and Z directions, such as described above with regard to the sleeve shown in FIG. 4B; however, the wall 512 also includes non-twisted, non-heat-settable yarn 524 extending in both the S and Z directions. The non-twisted, non-heat-settable yarn 524 is shown as being braided in pairs of side-by-side yarns, with each pair passing through a common loop 522 of the twisted bundles 521. Each of the non-twisted, non-heat-settable yarns 524 is braided such that each of the yarns 524 extending in an S-direction extend co-helically with and between bundles 521 extending in the S-direction and undulate over and under the yarns 524 extending in a Z-direction, and also undulate over and under corresponding heat-settable yarns 520 in the region of the loops 522, and each of the yarns 524 extending in a Z-direction extend co-helically with and between bundles 521 extending in the Z-direction and undulate over and under the yarns 524 extending in a S-direction, and also undulate over and under corresponding heat-settable yarns 520 in the region of the loops 522. As can be seen in the drawings, each yarn 520, 524 undulates over one yarn and then under the next yarn, thereby forming a plain braid, similar to a pattern that would be found in a plain weave, although braided, of course. The presence of the non-heat-settable yarn 524 functions to provide softness, flexibility and increased coverage protection to the sleeve 110. In the embodiment shown, a single pair of non-heat-settable yarn 524 extends between adjacent heat-settable bundles 521, in both the S and Z directions.

Figure 10E:
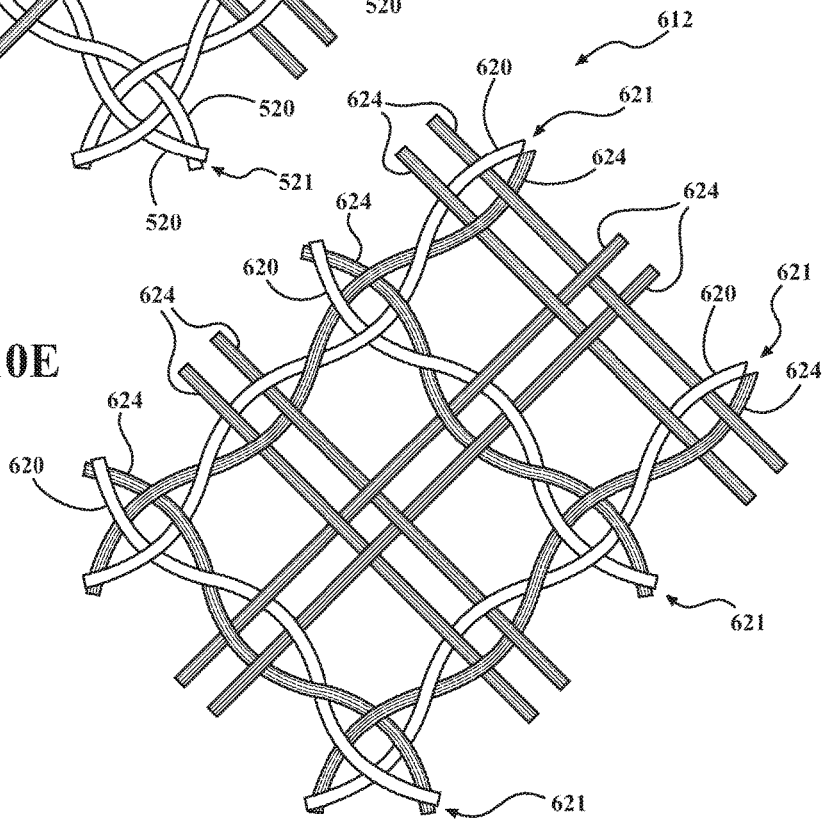
FIG. 10E is a view similar to FIG. 6 showing an enlarged fragmentary view of a wall of a sleeve constructed in accordance with yet another aspect of the invention.

In FIG. 10E, another embodiment of a wall 612 of the sleeve 110 of FIG. 8 is shown, wherein the same reference numerals as used above, offset by a factor of 600, are used to identify like features, wherein an enlarged fragmentary portion of the wall 612 is shown for simplicity, with it being understood that the remaining portion of the wall 612 is the same. The wall 612 is similar in construction to the wall 512; however, rather than the twisted bundles being formed entirely of heat-settable yarn, the twisted bundles 621 extending in at least one of the S or Z directions, and shown as extending in both the S and Z directions, are provided as a heat-settable yarn 620 twisted with a non-heat-settable yarn 624. Otherwise, the wall 612 includes the non-twisted, non-heat-settable yarns 624 as discussed above for the wall 512. Accordingly, the wall 612 has a slightly reduced presence of heat-settable yarn 620 and a slightly increased presence of non-heat-settable yarn 624 compared to the wall 512.

Figure 10F:
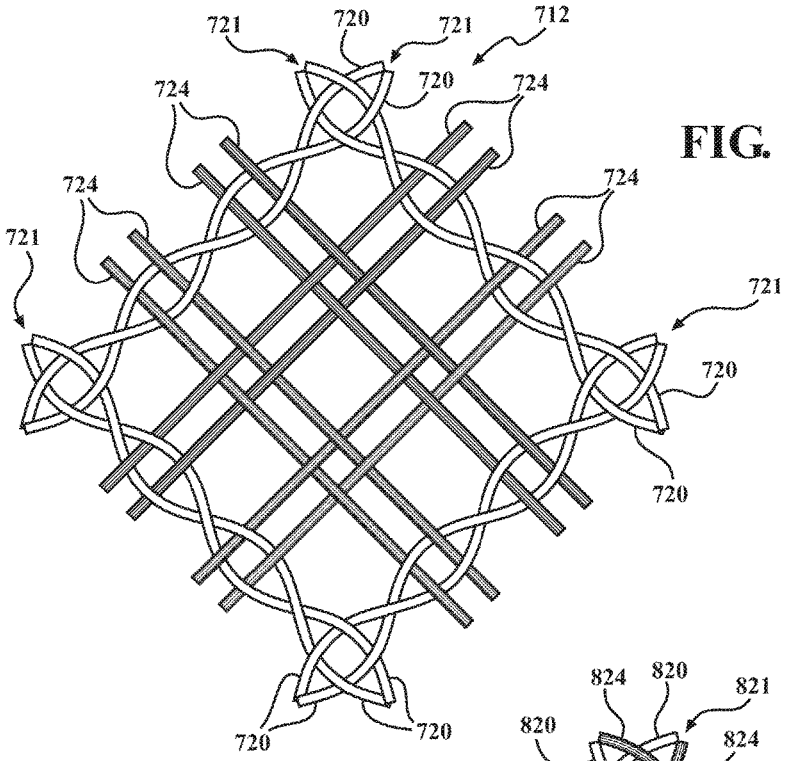
FIG. 10F is a view similar to FIG. 6 showing an enlarged fragmentary view of a wall of a sleeve constructed in accordance with yet another aspect of the invention.

In FIG. 10F, another embodiment of a wall 712 of the sleeve 110 of FIG. 8 is shown, wherein the same reference numerals as used above, offset by a factor of 700, are used to identify like features, wherein an enlarged fragmentary portion of the wall 712 is shown for simplicity, with it being understood that the remaining portion of the wall 712 is the same. The wall 712 is similar in construction to the wall 512; however, rather than having a single pair of non-twisted, non-heat-settable yarns extending between each twisted bundle 721 of heat-settable yarns 720, two separate pairs of non-twisted, non-heat-settable yarns 724 extend between each twisted bundle 721 of heat-settable yarns 720. As with the wall 512, each yarn 720, 724 undulates over one yarn and then under the next yarn, thereby forming a plain braid, similar to a pattern that would be found in a plain weave, although braided, of course. It should be recognized that the number of non-heat-settable yarns 724 extending between the heat-set bundles 721 could be different than as shown, depending on the requirements of the intended application. According, more non-heat-settable yarns 724 can be included where further enhance coverage protection is desired.

Figure 10G:
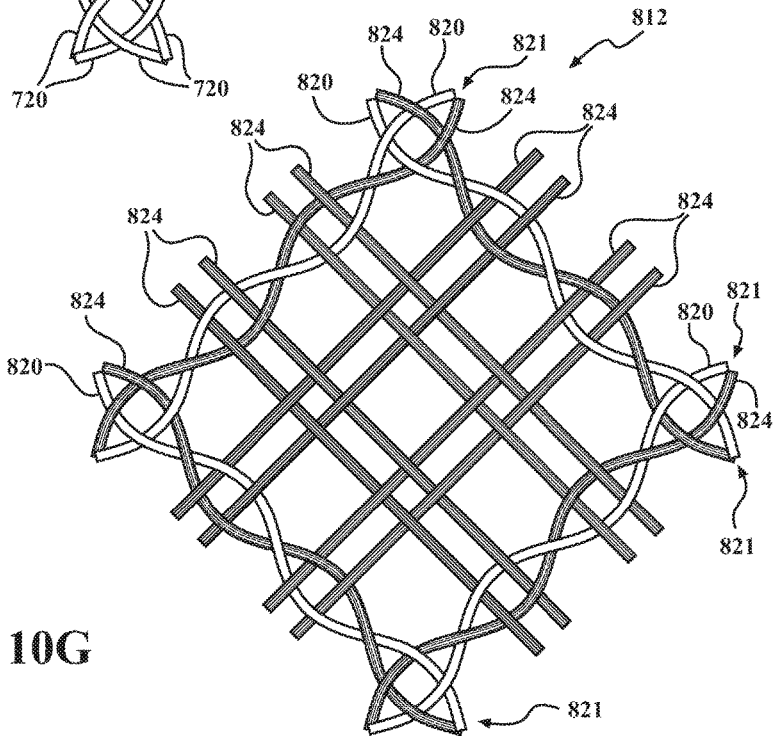
FIG. 10G is a view similar to FIG. 6 showing an enlarged fragmentary view of a wall of a sleeve constructed in accordance with yet another aspect of the invention.

In FIG. 10G, another embodiment of a wall 812 of the sleeve 110 of FIG. 8 is shown, wherein the same reference numerals as used above, offset by a factor of 800, are used to identify like features, wherein an enlarged fragmentary portion of the wall 812 is shown for simplicity, with it being understood that the remaining portion of the wall 812 is the same. The wall 812 is similar in construction to the wall 612; however, rather than having a single pair of non-twisted, non-heat-settable yarns extending between each twisted bundle of heat-settable and non-heat-settable yarns, two separate pairs of non-twisted, non-heat-settable yarns 824 extend between each twisted bundle 821 of heat-settable and non-heat-settable yarns 820, 824. As with the wall 512, each yarn 820, 824 undulates over one yarn and then under the next yarn, thereby forming a plain braid, similar to a pattern that would be found in a plain weave, although braided, of course. It should be recognized that the number of non-heat-settable yarns 824 extending between the heat-set bundles 821 could be different than as shown, depending on the requirements of the intended application. According, more non-heat-settable yarns 824 can be included where further enhance coverage protection is desired.

Figure 10H:
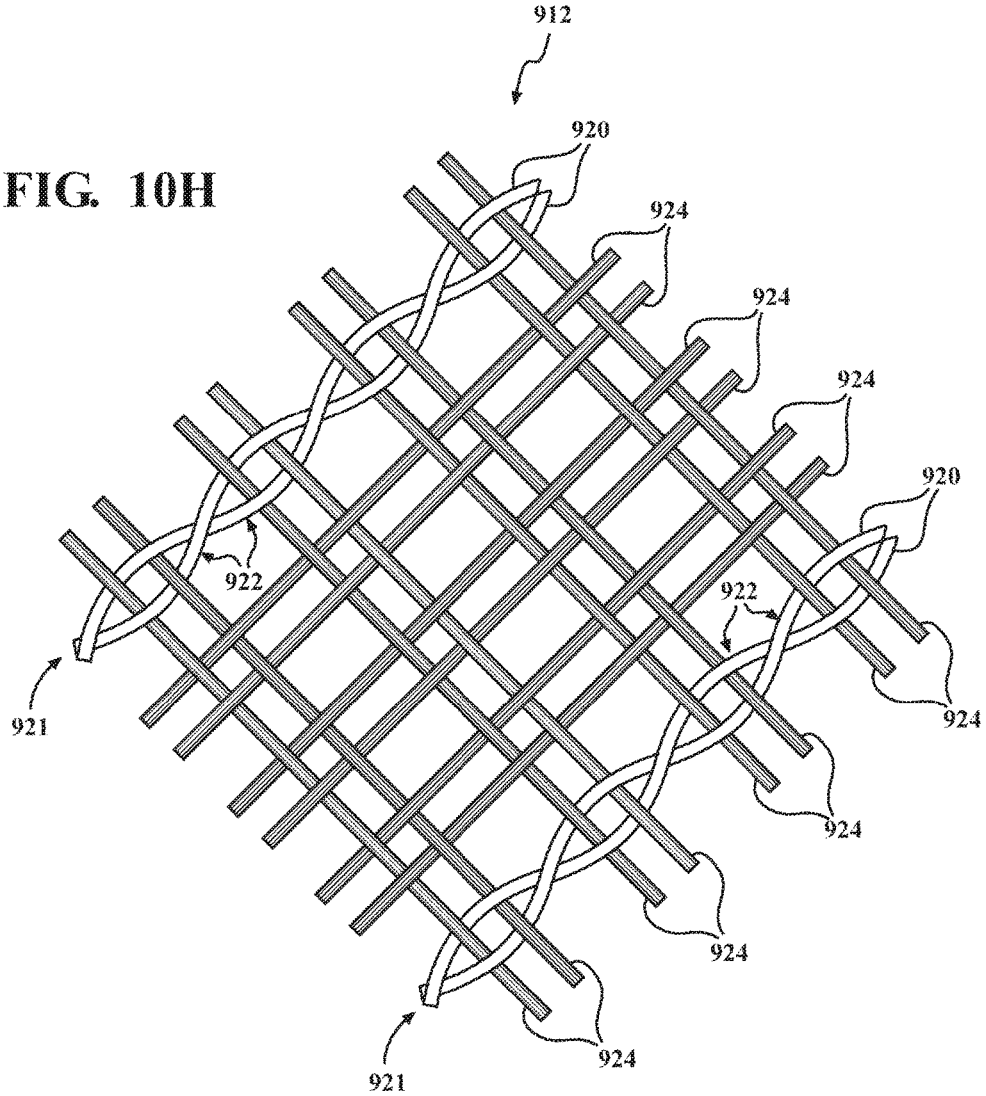
FIG. 10H is a view similar to FIG. 6 showing an enlarged fragmentary view of a wall of a sleeve constructed in accordance with yet another aspect of the invention.

In FIG. 10H, another embodiment of a wall 912 of the sleeve 110 of FIG. 8 is shown, wherein the same reference numerals as used above, offset by a factor of 900, are used to identify like features, wherein an enlarged fragmentary portion of the wall 912 is shown for simplicity, with it being understood that the remaining portion of the wall 912 is the same. The wall 912 includes twisted bundles 921 of heat-settable yarn 920 extending solely in one of an S or Z helical direction and non-twisted, non-heat-settable yarn 924 extending in both the S and Z helical directions. The non-heat-settable yarn 924 extending in the opposite S or Z direction to the heat-settable yarns 920 extend through loops 922 of the twisted bundles 921 in pairs, similarly as discussed above, with one non-heat-settable yarn 924 of each pair extending over-and-under one side of the loop 922 and the other non-heat-settable yarn 924 of each pair extending over-and-under and opposite side of the respective loop 922, as shown. The non-heat-settable yarn 924 extending in the same S or Z direction to the heat-settable yarns 920, thereby being parallel and co-helical therewith, extend over-and-under the heat-settable yarns 920 extending transversely to the heat-settable yarns 920, such as would be seen in a plain weave, but being braided, of course. In the embodiment shown, a total of 6 non-heat-settable yarns are shown extending between adjacent twisted bundles 921, though it is contemplated herein that the number could be more or fewer, depending on the needs of the intended application.

Figure 10I:
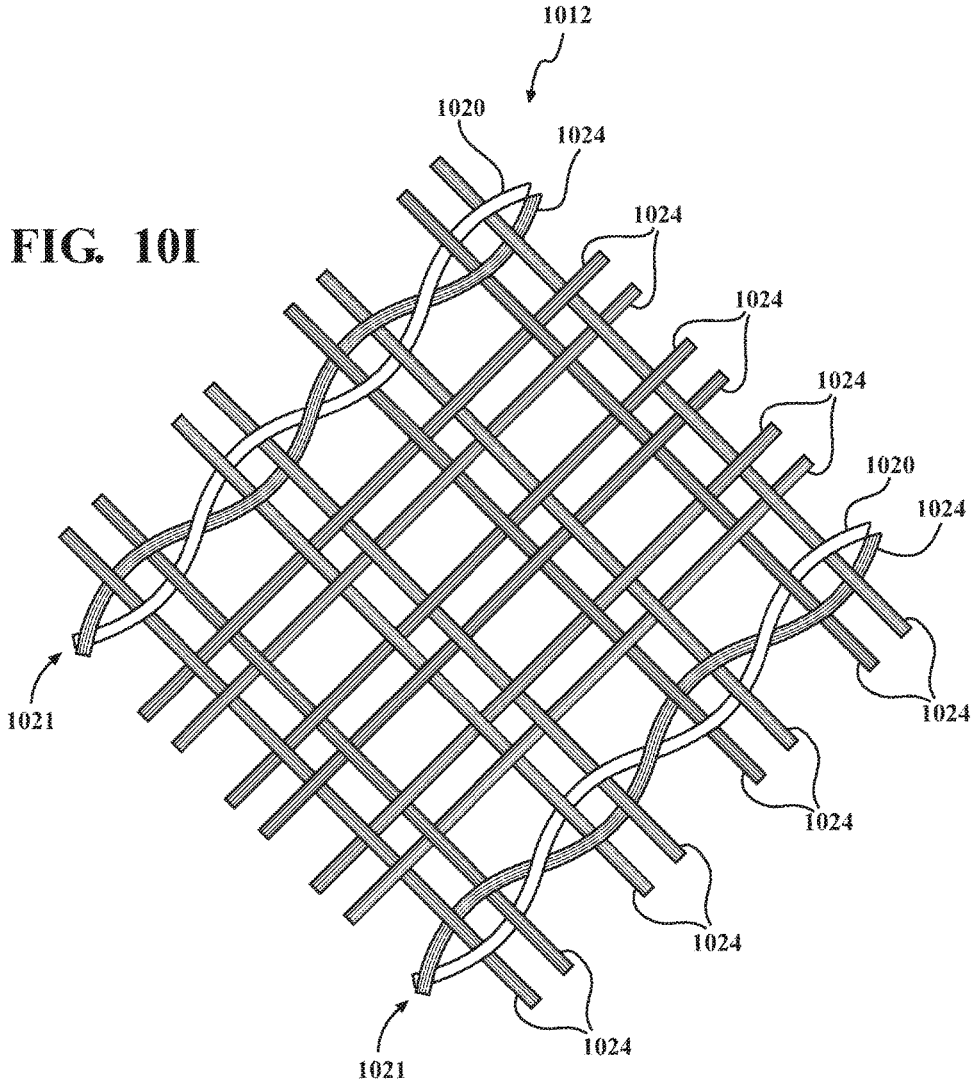
FIG. 10I is a view similar to FIG. 6 showing an enlarged fragmentary view of a wall of a sleeve constructed in accordance with yet another aspect of the invention.

In FIG. 10I, another embodiment of a wall 1012 of the sleeve 110 of FIG. 8 is shown, wherein the same reference numerals as used above, offset by a factor of 1000, are used to identify like features, wherein an enlarged fragmentary portion of the wall 1012 is shown for simplicity, with it being understood that the remaining portion of the wall 1012 is the same. The wall 1012 is similar to the wall 912, and includes twisted bundles 1021 extending solely in one of an S or Z helical direction and non-twisted, non-heat-settable yarn 1024 extending in both the S and Z helical directions. In contrast to the wall 912, the twisted bundles 1021 include a non-heat-settable yarn 1024 twisted with a heat-settable yarn 1020. As such, less heat-settable-yarn is included in the wall 1012 as compared to the wall 912; however, more non-heat-settable yarn 1024 is included in the wall 1012 as compared to the wall 912. As such, the wall 1012 is slightly more flexible, has a greater area of coverage protection, but has a slightly reduced ability to spring between the first and second states. Otherwise, the wall 1021 is the same as discussed above for the wall 912.

Figure 10J:
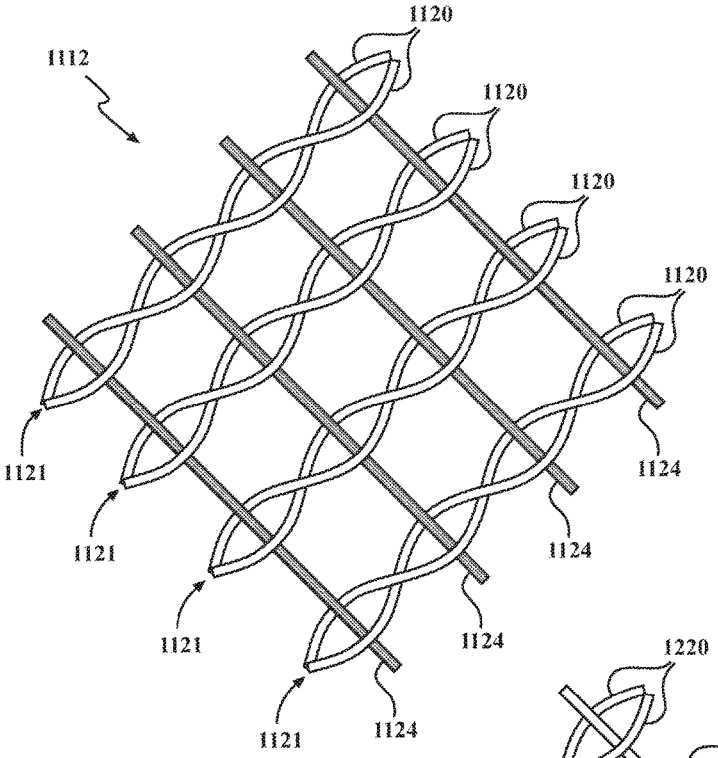
FIG. 10J is a view similar to FIG. 6 showing an enlarged fragmentary view of a wall of a sleeve constructed in accordance with yet another aspect of the invention.

In FIG. 10J, another embodiment of a wall 1112 of the sleeve 110 of FIG. 8 is shown, wherein the same reference numerals as used above, offset by a factor of 1100, are used to identify like features, wherein an enlarged fragmentary portion of the wall 1112 is shown for simplicity, with it being understood that the remaining portion of the wall 1112 is the same. The wall 1112 is similar to the wall 912; however, the wall 1112 includes twisted bundles 1121 extending solely in one of an S or Z helical direction and non-twisted yarn 1124 extending solely in the opposite S or Z helical direction from the twisted bundles 1121. Accordingly, all yarns extending in one of the S or Z directions are twisted bundles 1121, while all the yarns extending in the S or Z direction opposite the helical direction of the twisted bundles 1121 are non-twisted yarns 1124. The twisted bundles 1121 are shown as including all heat-settable yarns 1120, shown as heat-settable monofilaments, by way of example and without limitation, as it is contemplated that heat-settable multifilaments could be used. In addition, the non-twisted yarns 1124 are shown as including all non-heat-settable multifilaments, such as can be provided from the materials discussed above. As such, the twisted bundles 1121 extending in one of the S or Z directions, aside from providing protection to the elongate members being protected against abrasion, impart bias within the wall 1112 to provide the wall 1112 with bi-stable states, as discussed above. Meanwhile, the non-heat-settable, non-twisted yarns 1124 extending in the opposite helical direction S or Z provide the type of further coverage protection desired to the elongate members contained in the sleeve.

Figure 10K:
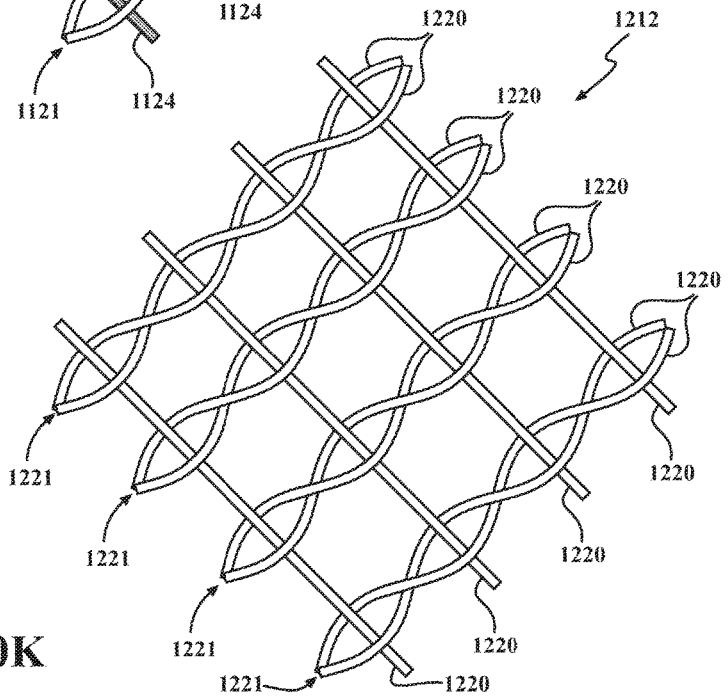
FIG. 10K is a view similar to FIG. 6 showing an enlarged fragmentary view of a wall of a sleeve constructed in accordance with yet another aspect of the invention.

In FIG. 10K, another embodiment of a wall 1212 of the sleeve 110 of FIG. 9 is shown, wherein the same reference numerals as used above, offset by a factor of 1200, are used to identify like features, wherein an enlarged fragmentary portion of the wall 1212 is shown for simplicity, with it being understood that the remaining portion of the wall 1212 is the same. The wall 1212 is similar to the wall 1112, with the wall 1212 having twisted bundles 1221 extending solely in one of an S or Z helical direction and non-twisted yarn 1220 extending solely in the opposite S or Z helical direction from the twisted bundles 1221. Accordingly, all yarns extending in one of the S or Z directions are twisted bundles 1221, while all the yarns extending in the S or Z direction opposite the helical direction of the twisted bundles 1221 are non-twisted yarns 1220. The twisted bundles 1221 are shown as including all heat-settable yarns 1220, shown as heat-settable monofilaments, by way of example and without limitation, as it is contemplated that heat-settable multifilaments could be used. In contrast to the wall 1112, the non-twisted yarns 1220 are shown as including all heat-settable monofilaments.

Figure 10L:
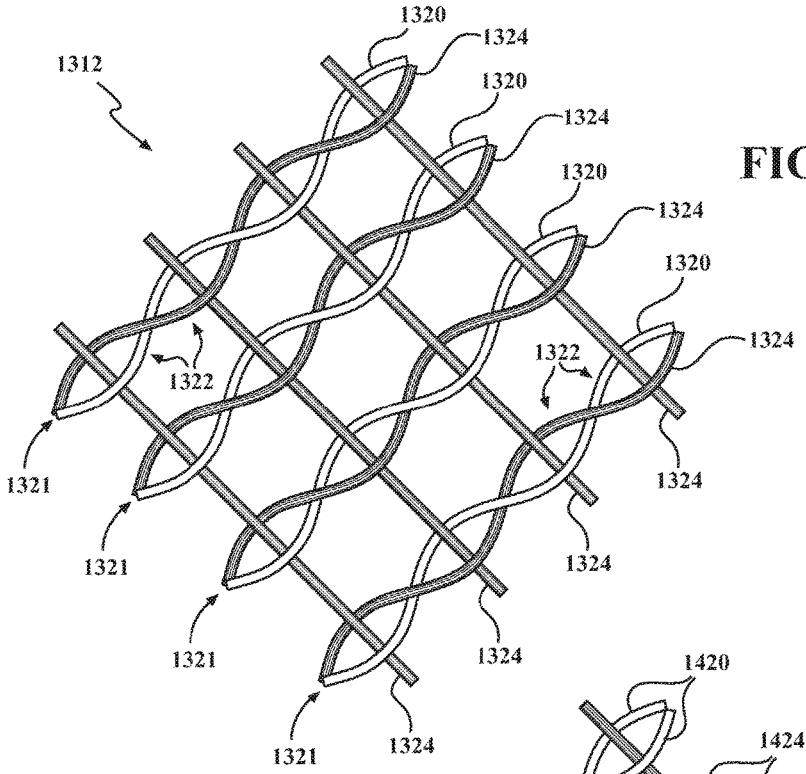
FIG. 10L is a view similar to FIG. 6 showing an enlarged fragmentary view of a wall of a sleeve constructed in accordance with yet another aspect of the invention.

In FIG. 10L, another embodiment of a wall 1312 of the sleeve 110 of FIG. 8 is shown, wherein the same reference numerals as used above, offset by a factor of 1300, are used to identify like features, wherein an enlarged fragmentary portion of the wall 1312 is shown for simplicity, with it being understood that the remaining portion of the wall 1312 is the same. The wall 1312 is similar to the wall 1112, with only the notable difference being discussed hereafter. Rather than the wall 1312 including twisted bundles solely comprising heat-settable yarn extending in one of a S or Z direction, the wall 1312 includes twisted bundles 1321, with each bundle 1321 including a heat-settable yarn 1320, shown as a monofilament, though heat-settable multifilaments are contemplated herein, and a non-heat-settable yarn 1324 twisted together, such as shown and described for the wall 1021 of FIG. 10I, with non-heat-settable yarns 1324 extending in the opposite S or Z direction to the bundles 1321 through loops 1322 thereof, such as shown and as shown and described for the wall 1112 of FIG. 10J.

Figure 10M:
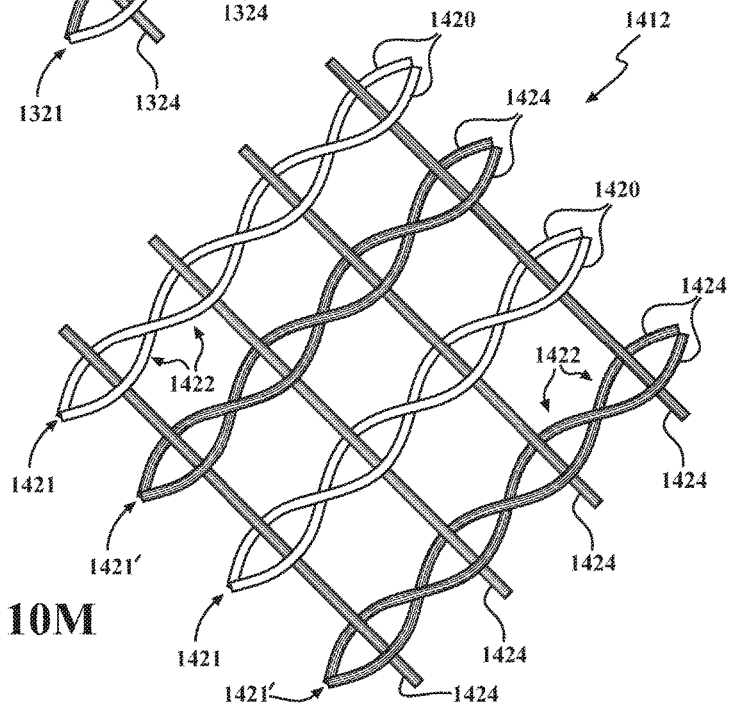
FIG. 10M is a view similar to FIG. 6 showing an enlarged fragmentary view of a wall of a sleeve constructed in accordance with yet another aspect of the invention.

In FIG. 10M, another embodiment of a wall 1412 of the sleeve 110 of FIG. 8 is shown, wherein the same reference numerals as used above, offset by a factor of 1400, are used to identify like features, wherein an enlarged fragmentary portion of the wall 1412 is shown for simplicity, with it being understood that the remaining portion of the wall 1412 is the same. The wall 1412 is similar to the wall 1112, with only the notable difference being discussed hereafter. Rather than the wall 1412 including twisted bundles solely comprising heat-settable yarn extending in one helical direction S or Z, with non-heat-settable yarn 1424 extending in an opposite helical direction S or Z therewith and through loops 1422 thereof, the wall 1412 includes twisted bundles 1421 of solely heat-settable yarn 1420, shown as monofilaments, though heat-settable multifilaments are contemplated herein, and twisted bundles 1421' of solely non-heat-settable yarn 1424, shown as non-heat-settable multifilaments. The respective twisted bundles 1421, 1421' are shown as alternating with one another and extending in the same helical direction S or Z with one another; however, it is to be recognized that any desired number and pattern of the respective twisted bundles 1421, 1421' is contemplated herein.

Many modifications and variations of the present invention are possible in light of the above teachings. In addition, it is to be recognized that a braided tubular wall constructed in accordance with the various aspects of the invention can take on a multitude of uses, including that of a protective member, a bundling member, or even a novelty item, by way of example and without limitation. It is, therefore, to be understood that the invention may be practiced otherwise than as specifically described, and that the scope of the invention is defined by any ultimately allowed claims.

What is claimed is:

1. A protective textile sleeve, comprising:

a braided, tubular wall extending lengthwise in relation to a central longitudinal axis between opposite ends; and said wall having at least one opening integrally formed therein, said at least one opening spanning a plurality of crossover nodes and having a circumferentially continuous periphery, said wall having a first state with a decreased length, extending from one of said opposite ends to the other of said opposite ends, increased cross-sectional area, and a second state with an increased length, extending from one of said opposite ends to the other of said opposite ends, decreased cross-sectional area, as viewed in cross-section taken generally transversely to said central longitudinal axis, and further including braided, heat-set yarns imparting a bias on said wall, said bias causing said wall to remain in each of said first and second states absent some externally applied force.

2. The protective sleeve of claim 1 wherein at least some of said heat-set yarns are braided in bundles, said bundles including a plurality of yarns twisted with one another.

3. The protective sleeve of claim 2 wherein at least some said bundles have loops interlinked with loops of another bundle.

4. The protective sleeve of claim 3 wherein at least some of said bundles are formed entirely of said heat-set yarns.

5. The protective sleeve of claim 3 wherein said wall includes non-heat-settable yarns.

6. The protective sleeve of claim 5 wherein at least some of said non-heat-settable yarns extend through at least some of said loops.

7. The protective sleeve of claim 6 wherein at least some of said non-heat-settable yarns extend co-helically between a pair of said bundles.

8. The protective sleeve of claim 3 wherein at least some of said bundles include non-heat-settable yarn.

9. The protective sleeve of claim 1 wherein said wall includes non-heat-settable yarns.

10. The protective sleeve of claim 2 wherein said bundles extend solely in one of a S or Z helical direction.

11. The protective sleeve of claim 2 wherein said bundles extend in opposite S and Z helical directions.

12. The protective sleeve of claim 1 wherein said wall has a non-circular outer periphery.

13. The protective sleeve of claim 1 wherein said at least one opening includes a plurality of openings.

14. The protective sleeve of claim 1 wherein said wall has opposite free edges extending along a length of the sleeve.

15. The protective sleeve of claim 14 wherein said opposite free edges are biased into overlapping relation with one another.

16. The protective sleeve of claim 1 wherein said wall is a seamless, circumferentially continuous wall.

17. A method of constructing a textile sleeve, comprising:

braiding a plurality of yarns with one another to form a wall extending lengthwise along a central longitudinal axis between opposite ends with at least some of said yarns being provided as heat-settable yarns, said wall having at least one opening spanning a plurality of crossover nodes integrally braided therein and being moveable between a decreased length, extending from one of said opposite ends to the other of said opposite ends, increased cross-sectional area first state and an increased length, extending from one of said opposite ends to the other of said opposite ends, decreased cross-sectional area second state; and heat-setting said heat-settable yarns while said wall is in one of said first state and second state to impart a bias on said wall via said heat-set yarns, said bias causing said wall to remain in each of said first and second states absent an externally applied axial force causing said wall to be moved to the other of said first or second state.

18. The method of claim 17 further including braiding said wall with a lace-braiding machine.

19. The method of claim 17 further including braiding said wall as a seamless, circumferentially continuous wall.

20. The method of claim 17 further including braiding said wall as a flat layer having said opposite free edges.

21. The method of claim 20 further including wrapping said wall about a mandrel and then performing the heat-setting.

22. The method of claim 17 further including forming the wall including non-heat-settable yarn.

23. The method of claim 17 further including forming at least some of the yarns as bundles of yarn twisted with one another.

24. The method of claim 23 further including forming at least some of the bundles entirely with heat-settable yarn.

25. The method of claim 23 further including forming at least some of the bundles including non-heat-settable yarn.

26. The method of claim 23 further including interlinking loops of one bundle with loops of another bundle to interlock the bundles with one another.

27. The method of claim 17 further including forming said at least one opening as a plurality of openings.

* * * * *